US012735832B2

(12) United States Patent
Park et al.

(10) Patent No.: US 12,735,832 B2
(45) Date of Patent: Sep. 15, 2026

(54) LAUNDRY TREATING APPARATUS AND METHOD FOR CONTROLLING THE SAME

(71) Applicant: LG Electronics Inc., Seoul (KR)

(72) Inventors: Bokyong Park, Seoul (KR); Sungho Song, Seoul (KR); Jaemyoung Lee, Seoul (KR); Sungmin Ye, Seoul (KR)

(73) Assignee: LG Electronics Inc., Seoul (KR)

( * ) Notice: Subject to any disclaimer, the term of this patent is extended or adjusted under 35 U.S.C. 154(b) by 88 days.

(21) Appl. No.: 18/965,627

(22) Filed: Dec. 2, 2024

(65) Prior Publication Data

US 2025/0179724 A1 Jun. 5, 2025

(30) Foreign Application Priority Data

Dec. 1, 2023 (KR) ..... 10-2023-0172689

(51) Int. Cl.
*D06F 73/02* (2006.01)

(52) U.S. Cl.
CPC ..... *D06F 73/02* (2013.01)

(58) Field of Classification Search
CPC ..... D06F 73/02
See application file for complete search history.

(56) References Cited

FOREIGN PATENT DOCUMENTS

| | | | |
|---|---|---|---|
| CN | 213232865 | U | 5/2021 |
| KR | 10-2009-0052460 | A | 5/2009 |
| KR | 10-2016-0066224 | A | 6/2016 |
| KR | 10-2023-0014481 | A | 1/2023 |
| KR | 10-2023-0140437 | A | 10/2023 |

OTHER PUBLICATIONS

International Search Report and Written Opinion in International Appln. No. PCT/KR2024/019285, mailed on Mar. 14, 2025, 10 pages (Official Copy Only).

*Primary Examiner* — Jason Y Ko
(74) *Attorney, Agent, or Firm* — Fish & Richardson P.C.

(57) ABSTRACT

The present disclosure relates to a laundry treating apparatus that generates steam to be supplied to hung laundry and steam to be supplied to an iron from a single heating part.

15 Claims, 26 Drawing Sheets

LAUNDRY TREATING APPARATUS AND METHOD FOR CONTROLLING THE SAME

CROSS-REFERENCE TO RELATED APPLICATIONS

This application claims the benefit of Korean Patent Application No. 10-2023-0172689, filed on Dec. 1, 2023, which is hereby incorporated by reference as if fully set forth herein.

TECHNICAL FIELD

The present disclosure relates to a laundry treating apparatus and a method for controlling the same. More specifically, the present disclosure relates to a laundry treating apparatus and a method for controlling the same that may perform a refreshing cycle such as sterilization, wrinkle removal, deodorization, and drying of laundry by supplying steam and hot air to the laundry.

BACKGROUND

When laundry is washed frequently with water and detergent, the laundry may be damaged or deformed.

To solve such problem, a laundry treating apparatus has been introduced that may perform a so-called refreshing cycle of spraying steam onto the laundry without wetting the laundry in water and evaporating steam with high-temperature air to remove wrinkles or odors from the laundry or to reorganize a fiber arrangement of the laundry (See Korean Patent Application Publication No. 10-2021-0144451).

Such a laundry treating apparatus may also be referred to as a laundry manager, and such a laundry treating apparatus may be equipped to hang the laundry without folding or crumpling the same and supply at least one of hot air and steam to the laundry.

In the past, a laundry treating apparatus that vibrates the hung laundry to more actively expose a surface of the laundry to steam/hot air and removes dust or foreign substances from the laundry has also been introduced (Korean Patent No. 10-1285890).

Recently, a laundry treating apparatus equipped with a steam iron that is mounted in the laundry treating apparatus, but is able to directly heat or pressurize the surface of the laundry by being withdrawn to the hung laundry has appeared. Accordingly, a user may hang the laundry inside the laundry treating apparatus and then manage the laundry with a refreshing cycle, or hang the laundry inside the laundry treating apparatus or on a door or a wall and then take out the steam iron to directly supply steam and heat to the laundry and remove the wrinkles from the laundry.

Recently, a laundry treating apparatus equipped with a machine room including a refreshing module T that supplies hot air to the hung laundry and circulates hot air again to condense water dried from the laundry, and an iron module S that has a steam iron I that directly supplies steam and hot air to the surface of the laundry has appeared.

Such a laundry treating apparatus is equipped with a steam supply T1 that supplies steam to a space where the laundry is hung and a steam generator S1 that supplies steam to the steam iron separately, and is equipped with a water supply pump T2 that supplies water to the corresponding steam supply T1 and a high-pressure pump S2 that supplies water to the steam generator S1 separately.

Accordingly, the existing laundry treating apparatus has an advantage of being able to selectively supply steam to the space where the laundry is hung and to the steam iron I, but has disadvantages of having to include a plurality of components for heating water and also having to have a plurality of components for supplying water.

Accordingly, the existing laundry treating apparatus has fundamental problems including all of the following: a production problem in which a manufacturing process is delayed and installation costs increase because all of the corresponding components have to be placed in the machine room; a management problem in which maintenance becomes difficult because the number of components that have to be maintained and repaired increases; and a control problem in which excessive current is consumed when the steam supply T1 and the steam generator S1 are controlled separately or simultaneously.

In addition, because the steam supply T1 is generally equipped to spray steam with a pressure lower than that of the steam generator S1, the existing laundry treating apparatus has a problem that only steam with the lower pressure is always supplied to the space where the laundry is hung compared to the steam iron I, making it difficult to supply sufficient steam to the laundry, or requiring a great time for the laundry to be exposed to sufficient steam.

SUMMARY

The present disclosure is to provide a laundry treating apparatus that may reduce a manufacturing process of the laundry treating apparatus equipped with an inner casing in which laundry is hung and a steam iron that sprays steam, and also lower manufacturing costs.

The present disclosure is to provide a laundry treating apparatus that may be easily installed and maintained even when equipped with a refreshing module that circulates air inside an inner casing and an iron module T that includes a steam iron.

The present disclosure is to provide a laundry treating apparatus that may simplify a configuration of a machine room in which a refreshing module and an iron module are installed.

The present disclosure is to provide a laundry treating apparatus that may adjust a pressure of steam sprayed also to the inner casing.

To solve the above-described problems, the present disclosure may provide a laundry treating apparatus that generates steam to be supplied to hung laundry and steam to be supplied to an iron from a single heating part.

In the present disclosure, a heating part may be disposed on one side of a circulation duct at the rear of the steam iron to supply steam to the steam iron, so that the heating part is able to supply steam to the inside of the inner casing as well.

The heating part may be connected to both the steam iron and the inner casing.

The laundry treating apparatus of the present disclosure may further include a guide pipe guiding steam supplied from the heating part to the inner casing, and a cable guiding steam supplied from the heating part to the steam iron.

The heating part may supply steam of different pressures to the guide pipe and the cable.

The heating part may supply steam such that a pressure of steam supplied to the steam iron is higher than a pressure of steam supplied to the inner casing.

The heating part may further include a valve assembly that selectively opens the guide pipe and the cable.

The valve assembly may close the cable when the guide pipe is opened.

The valve assembly may close the guide pipe when the cable is opened.

The heating part may further include an accommodating body that accommodates water therein and heats water, and a pressure sensor that senses a pressure of steam generated in the accommodating body.

The valve assembly may allow the supply of steam to the steam iron and block the supply of steam to the inner casing when the pressure of steam generated in the heating part is equal to or higher than a set value.

The valve assembly may block the supply of steam to the steam iron and guide steam to be supplied to the inner casing when the pressure of steam is equal to or lower than the set value.

The heating part may include an outlet allowing steam to be discharged from the accommodating body, and a branch pipe connecting the outlet with the guide pipe and the cable.

The pressure sensor and the valve assembly may be coupled to the branch pipe.

The pressure sensor may be disposed upstream of the valve assembly.

The valve assembly may include a first valve coupled to the branch pipe to selectively open and close the guide pipe, and a second valve coupled to the branch pipe to selectively open and close the cable.

The heating part may include a first outlet connecting the accommodating body with the guide pipe, and a second outlet connecting the accommodating body with the cable.

The valve assembly may include a first valve that opens and closes the first outlet, and a second valve that opens and closes the second outlet.

The laundry treating apparatus may further include a water supply tank detachably disposed in front of the circulation duct and storing water therein.

The heating part may receive water from the water supply tank and generate steam to be supplied to the steam iron and the inner casing.

The laundry treating apparatus may further include a water supply pump that supplies water stored in the water supply tank to the heating part.

The present disclosure may reduce the manufacturing process of the laundry treating apparatus equipped with the inner casing in which the laundry is hung and the steam iron that sprays steam, and also lower the manufacturing costs.

The present disclosure may be easily installed and maintained even when equipped with the refreshing module that circulates air inside the inner casing and the iron module T that includes the steam iron.

The present disclosure may simplify the configuration of the machine room in which the refreshing module and the iron module are installed.

The present disclosure may adjust the pressure of steam sprayed also to the inner casing.

DETAILED DESCRIPTION

Figure 1:
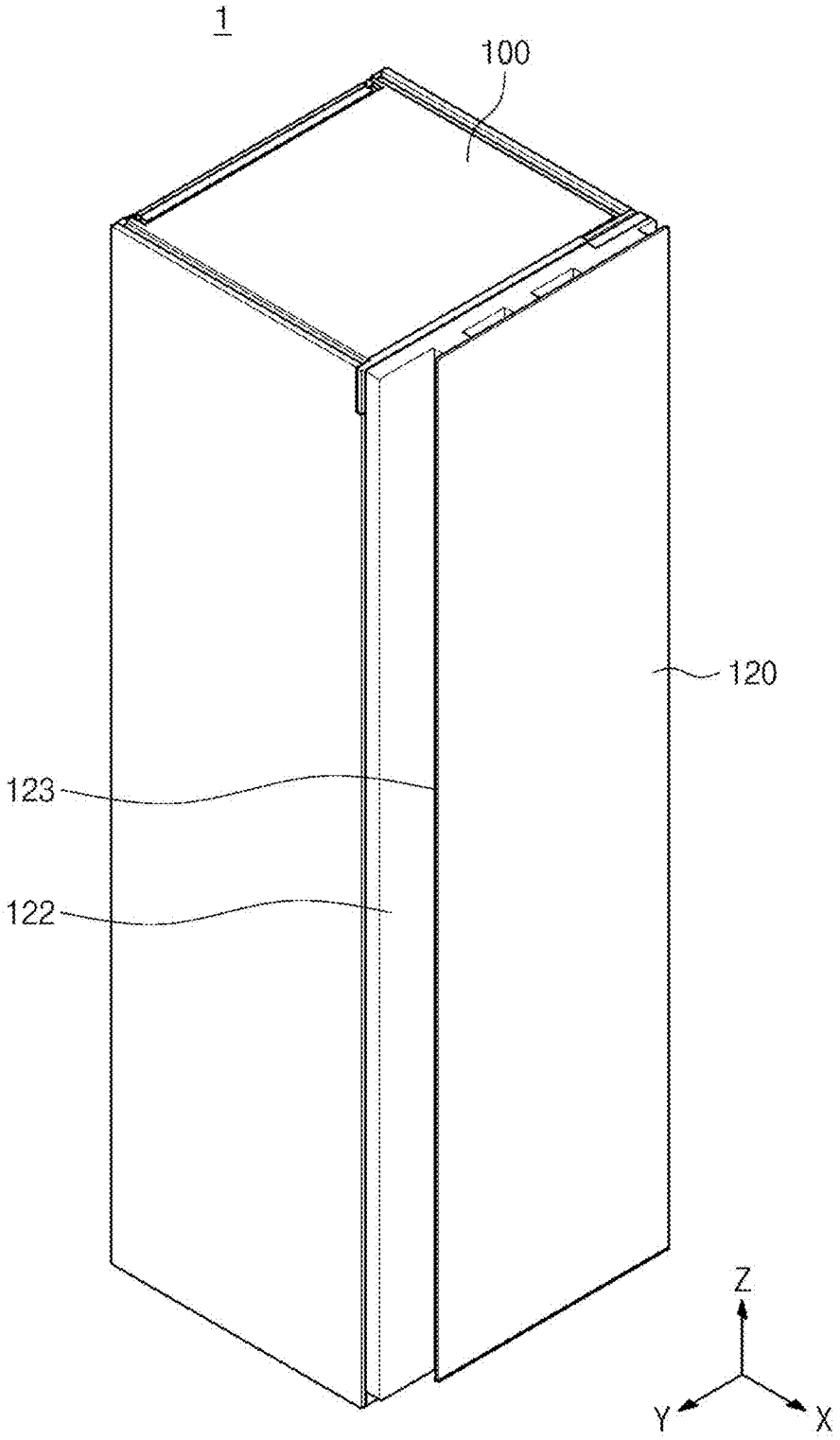
FIG. 1 shows an outer appearance of a laundry treating apparatus of the present disclosure.

Hereinafter, embodiments disclosed herein will be described in detail with reference to the attached drawings. In the present document, identical or similar components are assigned identical or similar reference numerals even in different embodiments, and descriptions thereof are replaced with the first description. A singular expression used herein includes a plural expression unless the context clearly indicates otherwise. In addition, when describing the embodiments disclosed herein, when it is determined that a detailed description of a related known technology may obscure the gist of the embodiments disclosed herein, the detailed description thereof will be omitted. In addition, it should be noted that the attached drawings are only intended to facilitate easy understanding of the embodiments disclosed herein, and the technical ideas disclosed herein should not be construed as being limited by the attached drawings.

FIG. 1 shows an embodiment in which an iron module S of the present disclosure is installed in a laundry treating apparatus equipped as a laundry manager.

The iron module S of the present disclosure may be installed in a machine room located inside a door or at a lower portion of the laundry treating apparatus.

Specifically, the laundry treating apparatus of the present disclosure may include a cabinet 100 forming an outer appearance, and a door 120 pivotably coupled to the cabinet 100.

The door 120 may include a main body 121 forming a front surface of the cabinet 100, and an installation body 122 extending from one side of the main body 121 and where a display for displaying information of the laundry treating apparatus may be installed.

The cabinet 100 may be constructed such that a height is greater than a width in a left and right direction and a thickness in a front and rear direction. Accordingly, in the laundry treating apparatus, even long laundry may be hung inside the cabinet 100 without being folded.

The installation body 122 may be extended from the main body 121 while forming a step rearward of the cabinet 100.

The installation body 122 may be made of a material or may have a color different from that of the main body 121. In addition, the installation body 122 may be made of a translucent material through which light emitted from the display may be transmitted.

A handle 123 may be disposed in an area where the installation body 122 and the main body 121 are stepped.

The handle 123 may be disposed on one surface of the main body 121 to extend forward of the installation body 122 in parallel with the main body 121. As a result, the handle 123 may be disposed to at least partly overlap the installation body 122 in the front and rear direction, and may define a space that the user may grip.

The cabinet 100 and the door 120 may be made of a metal material.

Figure 2:
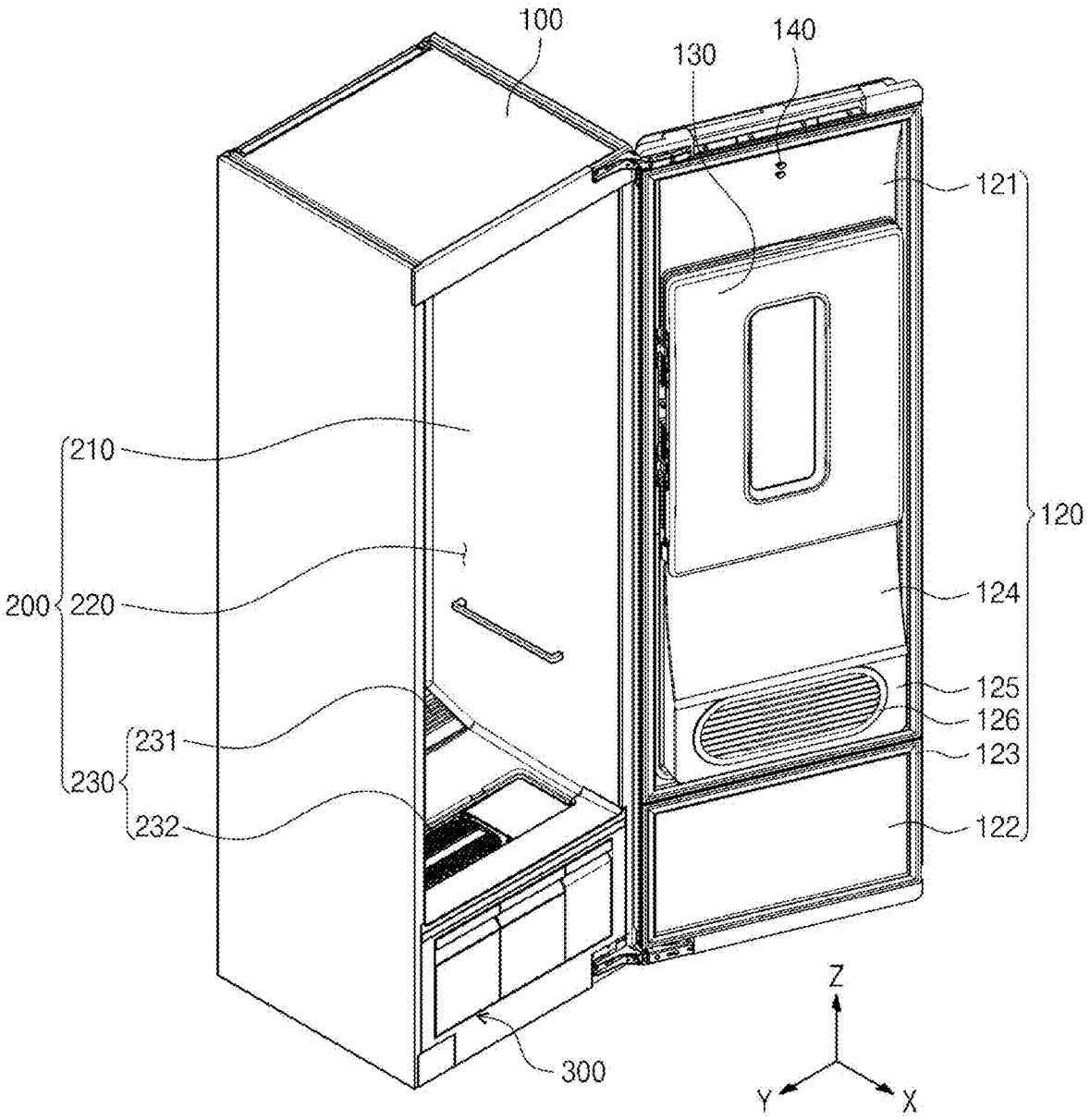
FIG. 2 shows interior of a cabinet of a laundry treating apparatus of the present disclosure.

FIG. 2 shows interior of a cabinet of a laundry treating apparatus of the present disclosure.

An inner casing 200 that has an accommodating space 220 for accommodating the laundry defined therein and defines an opening 210 in a front side through which the laundry is introduced may be disposed inside the cabinet 100.

The inner casing 200, which has a rectangular parallelepiped shape with an open front surface, may have a height smaller than that of the cabinet 100. As a result, an area in which a machine room 300 to be described below may be installed may be secured in the lower portion of the cabinet 100.

The inner casing 200 may have the height greater than a width and a thickness. As a result, the laundry may be hung inside the accommodating space 220 without being folded or wrinkled.

The inner casing 200 may be made of a plastic resin material, and may be made of a reinforced plastic resin material that does not deform even when exposed to air at a temperature higher than a room temperature or heated air (hereinafter, hot air) and steam or moisture.

A hanger where the laundry may be hung in the accommodating space 220 may be disposed in an upper portion of an inner surface of the inner casing 200. The hanger may be formed in a clothes hanger shape and may be fixed to a top surface of the inner casing 200. Because of the hanger, the laundry may be disposed in the unfolded state and in a state of being suspended in air within the accommodating space 220.

A plurality of the hangers may be disposed along a width direction of the inner casing 200. As a result, a plurality of laundry pieces may be hung, spaced apart from each other within the inner casing 200.

The hanger may be constructed as a moving hanger that reciprocates or rotates in a reciprocating manner in the width direction within the inner casing 200. The laundry treating apparatus of the present disclosure may shake the laundry inside the inner casing because of the hanger, and the laundry may be shaken inside the accommodating space 220, thereby removing foreign substances, dust, and the like, and also removing wrinkles formed on the laundry.

The laundry treating apparatus of the present disclosure may be equipped with the machine room 300 in which various apparatuses are installed, which may supply at least one of high-temperature air, heated air (hereinafter, hot air), and steam to the accommodating space 220 or purify or dehumidify outside air of the cabinet 100.

The machine room 300 may be disposed separately or partitioned from the inner casing 200, but may be in communication with the accommodating space 220.

The machine room 300 may be disposed under the inner casing 200. Accordingly, when hot air and steam having a low specific gravity are supplied to the inner casing 200, hot air and steam may naturally rise in the accommodating space 220 and be supplied to the hung laundry.

The inner casing 200 may be partitioned and separated from the machine room 300 via a bottom surface 230. However, a plurality of through-holes may be defined in the bottom surface 230 to be in communication with the machine room 300.

To this end, the inner casing 200 may have a plurality of through-holes 230 that extend through one surface thereof and are in communication with the machine room 300.

Via the through-holes 230, air in the accommodating space 220 may be supplied to the machine room 300 and at least one of hot air and steam generated in the machine room 300 may be supplied to the accommodating space 220.

The through-holes 230 may include an inflow hole 232 extending through the bottom surface 230 of the inner casing 200 and allowing air inside the inner casing 200 to be discharged or sucked into the machine room 300, and an exhaust hole 231 extending through the bottom surface of the inner casing 200 and allowing hot air generated in the machine room 300 to be discharged.

The exhaust hole 231 may be defined to be biased rearward in the bottom surface of the inner casing 200. In addition, the inflow hole 232 may be defined to be biased forward in the bottom surface of the inner casing 200. As a result, a separation spacing between the inflow hole 232 and the exhaust hole 231 may be secured on the bottom surface 230 of the inner casing 200, and hot air supplied from the exhaust hole 231 may be prevented from being directly discharged to the inflow hole 232.

The through-holes 230 may further include a steam hole 233 into which steam generated in a heating part 800 to be described below is supplied. The steam hole 233 may be defined closer to the exhaust hole 231 than to the inflow hole 232. For example, the steam hole 233 may be defined on one side of the exhaust hole 231. As a result, steam discharged from the steam hole 233 may be prevented from flowing directly into the inflow hole 232.

The door 120 may be pivotably coupled to the cabinet 100.

A height of the door 120 may correspond to the height of the cabinet 100. As a result, the door 120 may open and close the opening 210, and may also shield the machine room 300.

When the door 120 is closed, the opening 210 and the machine room 300 may be prevented from being exposed forward.

The door 120 may include a door body 121 forming a main body and a sealing member 123 coupled to an inner surface of the door body 121 to seal the opening 210.

The sealing member 123 may be disposed in an area facing a periphery of the opening 210 on the inner surface of the door body 121 to seal the opening 210.

In one example, the door body 121 may include a protective panel 122 that shields the machine room 300 and protects the machine room 300 under the sealing member 123 that seals the opening 210.

The sealing member 123 may extend downward of the opening 210 to also seal a front periphery of the machine room 300.

The door 120 may include a protruding portion 125 that protrudes from the inner surface of the door body 121 such that at least a portion thereof may be inserted into the opening 210.

The protruding portion 125 may protrude from the door body 121 to an extent that it is disposed in front of the inflow hole 232 when the door 120 closes the opening 210.

The protruding portion 125 may have a width corresponding to a width of the opening 210. The protruding portion 125 may be disposed closer to a lower portion of the opening 210 or the bottom surface 230 of the inner casing 200 than to an upper end of the door body 121.

As a result, hot air and steam in the accommodating space 220 of the inner casing may be guided to be introduced into the inflow hole 232, and may be prevented from being discharged out of the opening 210 and being exposed to the machine room 300.

A height of the protruding portion 125 may be smaller than ⅓ of the height of the inner casing 200, and a thickness of the protruding portion 125 protruding from the door body 121 may be smaller than a spacing from a front edge of the bottom surface 230 to the inflow hole 232.

The door body 121 may further include a curved surface 124 extending toward the protruding portion 125 on the inner surface thereof. The curved surface 124 may be formed in a downwardly convex shape. The curved surface 124 may induce hot air and steam supplied to the accommodating space 220 to circulate inside the accommodating space 220.

The laundry treating apparatus of the present disclosure may include a pressurizer 130 that is pivotably coupled to the inner surface of the door body 121 to pressurize the laundry, and a fixer 140 that may hang the laundry at a vertical level higher than that of the pressurizer 130.

The pressurizer 130 may pivot in a width direction of the door 120 to pressurize the laundry hung on the fixer 140.

Accordingly, by pressing the laundry hung on the fixer 140 with the pressurizer 130, the wrinkles in the laundry may be removed, and intended creases may also be formed in the laundry.

The curved surface 124 may extend from a lower end of the pressurizer 130 to the protruding portion 125. Accordingly, when water condensed in the laundry hung on the fixer 140 flows along the pressurizer 130 or the inner surface of the door body 121, water may flow along the curved surface 124 and be guided to the bottom surface 230 and may be prevented from flowing to the opening 210 or the sealing member 123. As a result, the machine room 300 may be prevented from being contaminated with water, steam, hot air, the foreign substances, and the like.

The protruding portion 125 may have an exposed surface disposed parallel to a rear surface of the inner casing 200, and a bottom surface extending from a lower portion of the exposed surface may be disposed parallel to the bottom surface 230 of the inner casing.

The exposed surface of the protruding portion 125 may have a through-hole 126 that extends through the exposed surface to allow air to enter and exit, and may have a duct through which air may flow in a space defined by the protruding portion 125, the curved surface 124, and the door body 121.

The door body 121 may have a communication hole in communication with the duct in an area of the inner surface corresponding to the pressurizer 130.

Accordingly, hot air and steam flowing in the inner casing 200 may be introduced into the through-hole 126 and discharged via the communication hole to dry the laundry hung on the pressurizer 130 or circulate air inside the inner casing 200.

Figure 3:
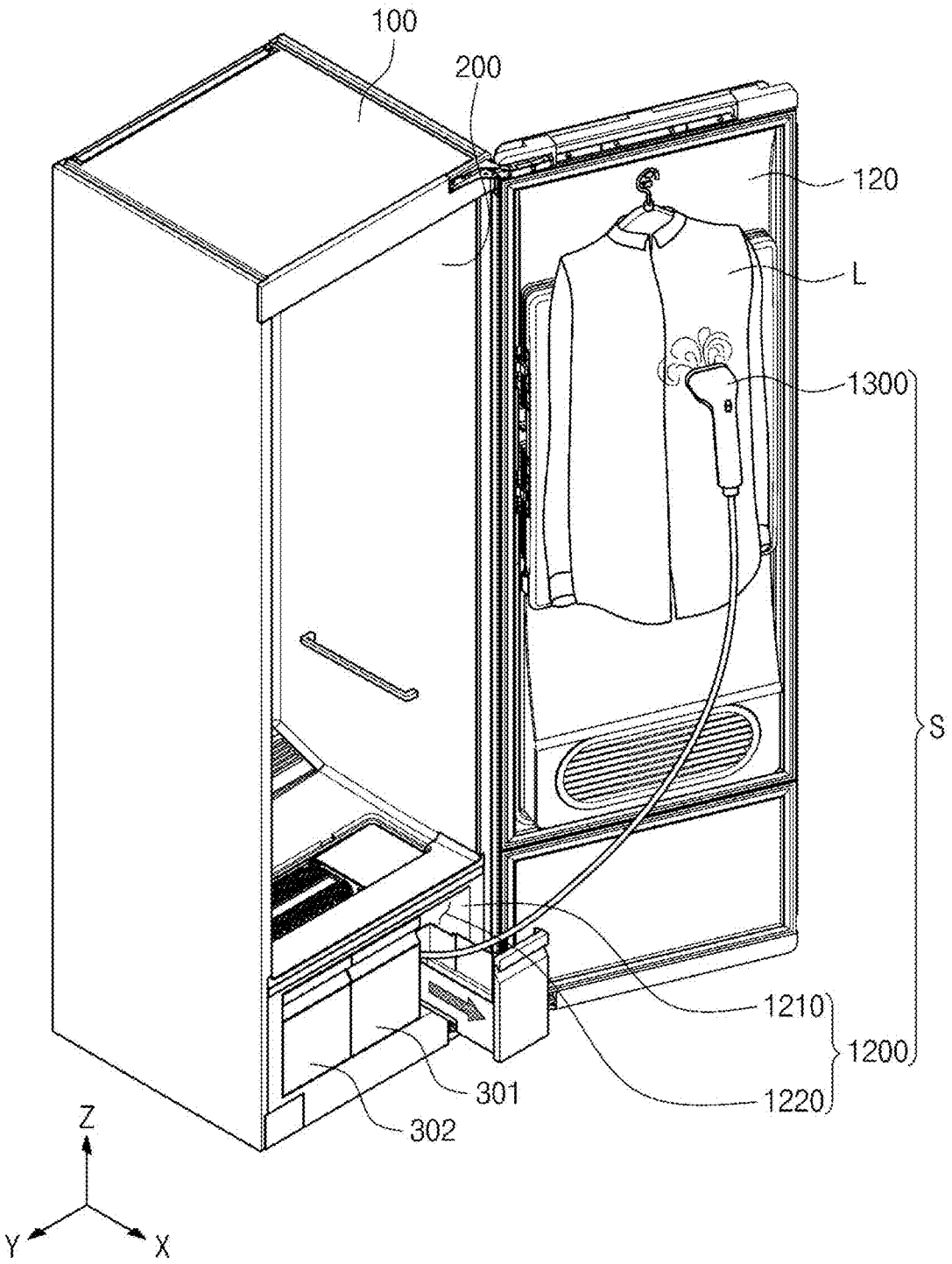
FIG. 3 shows an outer appearance of the machine room.

FIG. 3 shows an outer appearance of the machine room 300.

The machine room 300 is equipped to supply at least one of hot air and steam to the inner casing 200. To this end, the machine room 300 should be supplied with water necessary to generate steam and should collect steam supplied to the inner casing 200 or water condensed from the laundry.

To this end, the machine room 300 may include a water supply tank 301 that stores water required for generating steam, and a drainage tank 302 that collects water condensed inside the laundry treating apparatus.

The water supply tank 301 and the drainage tank 302 may be disposed in a front portion of the machine room 300. As a result, it may be easy for a user to fill the water supply tank 301 with water or empty water in the drainage tank 302, and the laundry treating apparatus may be disposed without being limited by locations of a water source and a drain.

The laundry treating apparatus of the present disclosure may include an iron module S installed with a steam iron 1300.

The iron module S may be installed in the machine room 300.

The iron module S may supply heat and steam to the surface of the laundry.

The iron module S may further include a storage 1200 that stores the steam iron 1300, which may spray or supply at least one of heat and steam to the surface of the laundry, inside the machine room 300.

The storage 1200 may include a storage body 1210 that is mounted in the machine room 300 and provides a space in which the steam iron 1300 is stored, and an open surface 1220 that is defined in a front surface of the storage body 1210 and through which the steam iron 1300 is inserted and withdrawn.

The steam iron 1300 may be withdrawn from the machine room 300 while being withdrawn forward of the storage body 1210. The steam iron 1300 may reach the surface of the laundry hung on the fixer 140 or the hanger when withdrawn forward of the machine room 300.

The steam iron 1300 may transmit heat and steam to an upper end of the pressurizer 130 of the door 120, which is located upward of a midpoint in a height direction of the inner casing 200. The steam iron 1300 may be in contact with the surface of the laundry or may be disposed close to the surface of the laundry to directly spray heat and steam to the surface of the laundry.

For example, the steam iron 1300 may reach the hanger or the fixer 140. In addition, the steam iron 1300 may move to a top surface of the accommodating space 220 or an upper end of the inner surface of the door 120 when withdrawn from the storage 1200.

The steam iron 1300 may supply heat to the surface of the laundry or may spray steam to the surface of the laundry. The steam iron 1300 may be equipped as a general steam iron or a general steamer. The steam iron 1300 may be equipped as any component as long as it satisfies a condition of removing the wrinkles that have occurred in the laundry.

Laundry L fixed to the hanger or the fixer 140 may be supported on the inner surface of the door 120 or an inner surface of the inner casing 200 and may be exposed to at least one of heat and steam supplied from the steam iron 1300. In this process, the laundry L may be refreshed or wrinkles thereof may be removed.

The iron module S may be exposed to the front surface of the machine room 300, because the steam iron 1300 should be withdrawn from the machine room 300 to the laundry hung in the inner casing 200 or on the door 120.

For example, a front surface of the iron module S may be disposed on one side of the water supply tank 301 or the drainage tank 302, and both side surfaces thereof may be disposed inside the machine room 300.

The water supply tank 301 and the drainage tank 302 may be shared by the iron module S and a refreshing module T.

Figure 4:
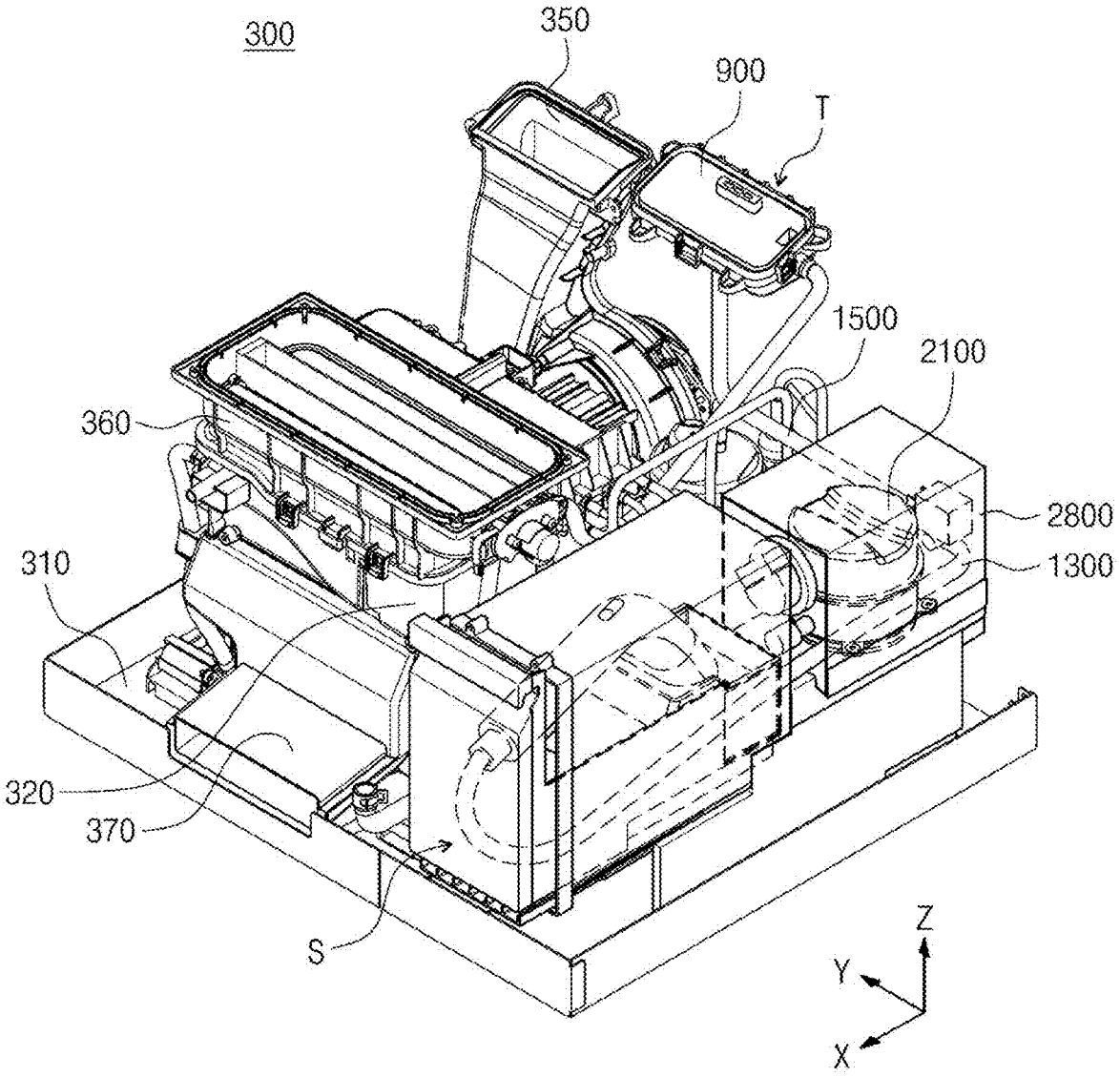
FIG. 4 shows a structure of a machine room of a laundry treating apparatus of the present disclosure.

FIG. 4 shows a structure of a machine room of a laundry treating apparatus of the present disclosure.

The machine room 300 may include therein the refreshing module T equipped as a component that may supply hot air and steam to the laundry hung in the accommodating space 220, circulate air inside the accommodating space, or circulate air outside the cabinet, and the iron module S including the steam iron 1300.

The refreshing module T may include all apparatuses and components that may supply at least one of hot air and steam into the inner casing 200.

Specifically, the machine room 300 may include a base 310 on which a space where the various apparatuses described above may be supported or installed, a circulation duct 320 that is installed on or extended from the base 310 and provides a flow channel through which air inside the inner casing 200 or air outside the cabinet 100 flows, a blower 350 that is mounted on the circulation duct 320 and provides power to allow air to flow, and a heat supply part 340 that cools and heats air flowing along the circulation duct 320 to generate hot air.

The base 310 may be formed as a plate on which the various apparatuses are installed.

The circulation duct 320 may form a flow channel through which air introduced from the inner casing 200 or the outside of the cabinet 100 flows, and may be formed in a casing shape with an open top.

The heat supply part 340 may include a heat exchanger disposed inside the circulation duct 320 to cool air, condense moisture, and reheat air, and a compressor disposed outside the circulation duct 320 to receive a refrigerant from the heat exchanger or supply the refrigerant.

The refreshing module may further include an outside air duct 370 that sucks outside air in front of the circulation duct 320 and guides sucked air into the circulation duct 320.

The circulation duct 320 may be in communication with the outside air duct 370 and selectively suck outside air.

The water supply tank and the drainage tank may also be included in the refreshing module T.

The water supply tank and the drainage tank may be detachably coupled to a front surface of the circulation duct 320. For example, the water supply tank 301 and the drainage tank 302 may be seated and disposed on the outdoor air duct 370.

The circulation duct 320 may be coupled to the base 310, but may be formed integrally with the base 310. For example, the base 310 and the circulation duct 320 may be simultaneously manufactured via injection molding.

The refreshing module T may include a base cover 360 disposed to allow the circulation duct 320 and the inflow hole 232 to be in communication with each other.

The base cover 360 may be coupled to an upper portion of the circulation duct 320 to guide air sucked in the inflow hole 232 into the circulation duct 320.

The base cover 360 may block air inside the circulation duct 320 from being discharged to the outside by shielding a top surface of the circulation duct 320. A lower portion of the base cover 360 and the top surface of the circulation duct 320 may form one surface of a flow channel of the circulation duct 320.

The base cover 360 may include an inlet 362 that allows the inflow hole 232 and the circulation duct 320 to be in communication with each other therein. The inlet 362 may be formed in a duct shape to serve as an intake duct that delivers air inside the inner casing 200 to the circulation duct 320.

The blower 350 may allow the circulation duct 320 and the exhaust hole 231 to be in communication with each other.

The iron module S may be disposed on a left or right side of the refreshing module T inside the machine room 300. Specifically, the iron module S may be disposed outside the circulation duct 320. Accordingly, the iron module S may not obstruct a flow or air flowing through the circulation duct 320.

In one example, the laundry treating apparatus of the present disclosure may further include a steam nozzle 900 that receives steam and is disposed on the bottom surface of the inner casing 200 to supply steam into the inner casing 200.

The steam nozzle 900 may be disposed on a bottom surface of the steam hole 233 to be in communication with the steam hole 233.

The steam nozzle 900 may be formed in a casing shape with a width greater than a depth in a front and rear direction, so that supplied steam may be induced to be supplied to the entire inner casing 200 and supplied steam may be prevented from leaking into the machine room 300.

The iron module S may be disposed in a parallel manner along a length direction of the circulation duct 320 at one side of the base 310.

The iron module S may be disposed on one side of the circulation duct 320.

The iron module S may include the steam iron 1300 and a heating part 2100 that supplies steam to the steam iron 1300.

The heating part 2100 may supply steam not only to the steam iron 1300, but also to the inner casing 200.

The iron module S may include the cable 1400 that extends from the heating part 2100 to the steam iron 1300 to supply steam generated in the heating part 2100, and the guide pipe 1500 that extends from the heating part 2100 to the bottom surface of the inner casing 200 or the steam nozzle 900 to supply steam generated in the heating part 2100. As a result, the refreshing module T and the iron module S may share one heating part 2100.

In addition, because the steam iron 1300 is generally equipped to supply steam with a pressure equal to or higher than the atmospheric pressure, the heating part 2100 may generate high-pressure steam. Because the heating part 2100 is also able to supply steam into the inner casing 200, high-pressure steam may also be supplied to the inner casing 200. As a result, because sufficient steam may be supplied to the laundry hung in the inner casing more quickly, time for supplying steam into the inner casing 200 may be reduced.

Accordingly, time for performing the refreshing process may be reduced, so that energy may also be saved.

Therefore, because of the heating part 2100, the refreshing module T may omit a separate steam generating apparatus.

A component itself that supplies steam to a top surface of the circulation duct 320 may be omitted. In this case, a separation distance between the top surface of the circulation duct 320 and the bottom surface of the inner casing 200 may be increased. Therefore, air flowing through the circulation duct 320 or the heat supply part accommodated in the circulation duct 320 may be minimized from affecting the bottom surface of the inner casing 200.

The heating part 2100 may be disposed at the rear of the steam iron 1300. Accordingly, because an overall volume of the refreshing module T may be reduced, manufacturing and installation, as well as maintenance and repair of the refreshing module T may be simplified.

In addition, because an overall configuration of the machine room 300 becomes relatively simple and a volume thereof is reduced, installation, maintenance and repair of the iron module S may also be simplified.

In one example, the heating part 2100 may further include a valve assembly 2800 that determines whether to supply steam to the steam iron 1300 and the inner casing 200.

The laundry treating apparatus of the present disclosure may control the valve assembly 2800 to determine whether to supply steam to the inner casing 200 and the steam iron 1300.

As a result, even when steam is generated in the heating part 2100, it may be prevented from being arbitrarily supplied to the inner casing 200 and the steam iron 1300.

Figure 5:
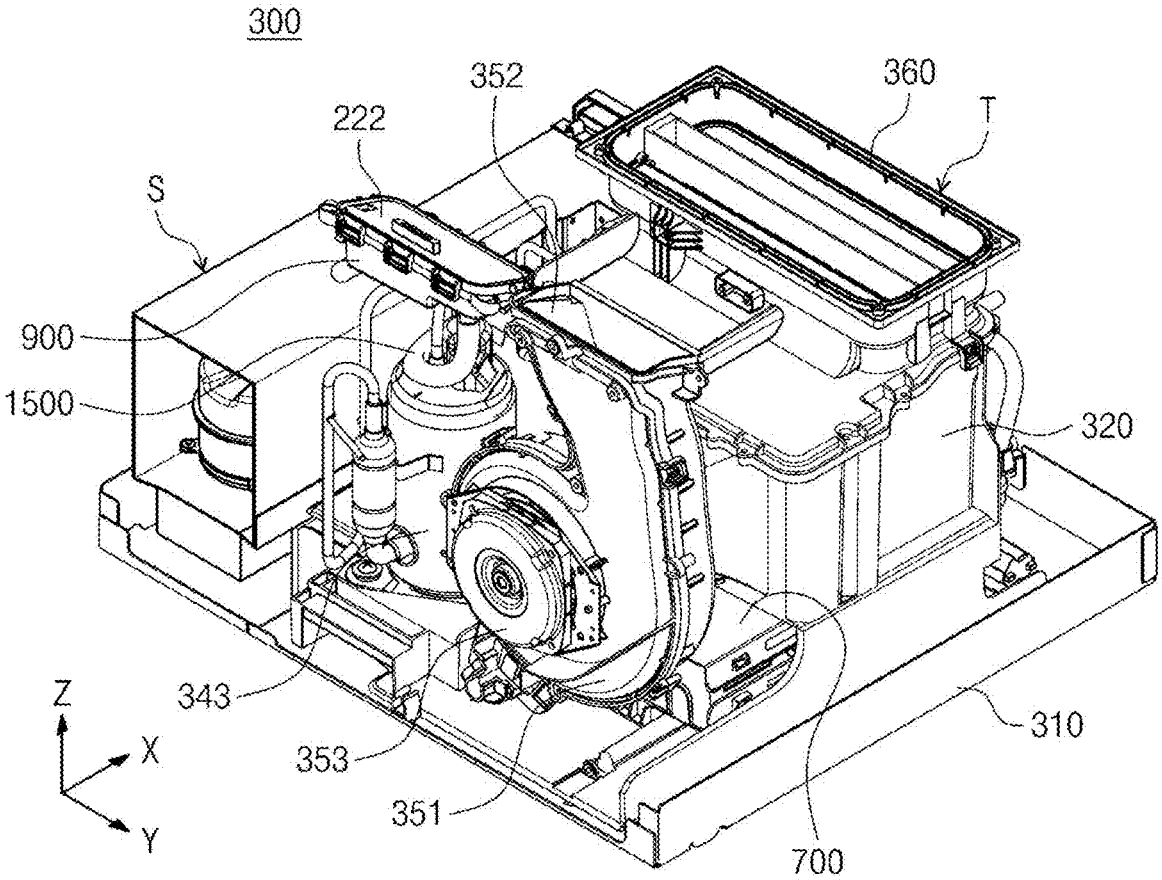
FIG. 5 is a rear view of the machine room.

FIG. 5 is a rear view of the machine room.

The blower 350 may include a blower fan 353 that provides power for air inside the circulation duct 320 to flow in one direction, and a fan housing 351 that accommodates the blower fan 353 therein and is coupled to or extended from the circulation duct 320.

The blower 350 may include an exhaust duct 352 that allows the circulation duct 320 and the exhaust hole 231 to be in communication with each other.

The exhaust duct 352 may be formed with a cross-section extending from the fan housing 351 toward exhaust hole 231 in an area size corresponding to that of exhaust hole 231.

As a result, air inside the inner casing 200 may be introduced via the base cover 360, pass through the circulation duct 320, and then be supplied back into the inner casing 200 via a fan installation portion 350.

The heat supply part 340 may include a compressor 343 installed on the base 310 to exchange heat with air flowing through the circulation duct 320. The compressor 343 may be disposed on a left or right side of the circulation duct 320, and may be disposed between the circulation duct 320 and the iron module S.

Figure 6:
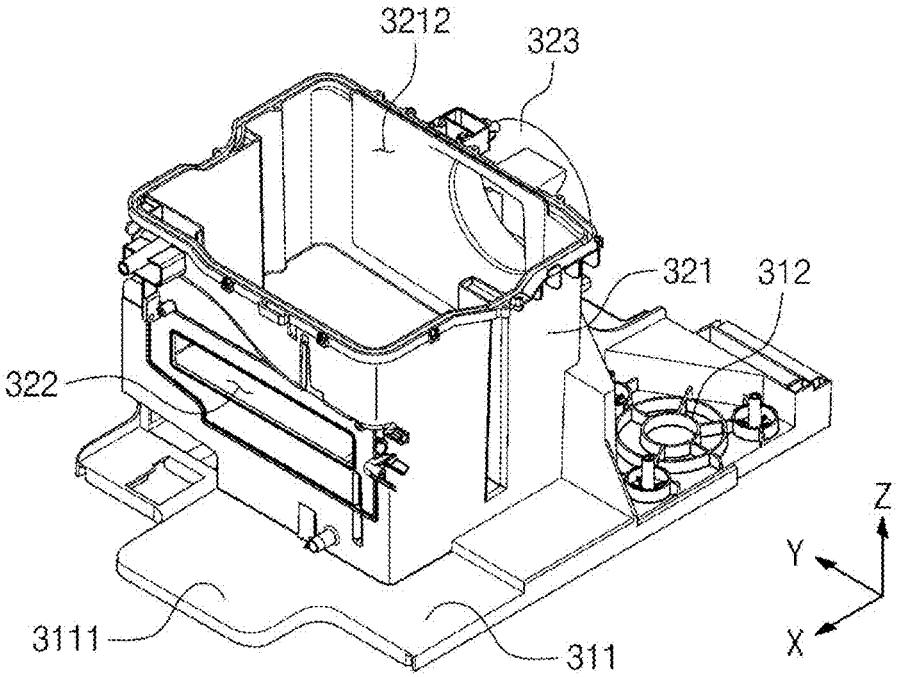
FIG. 6 shows structures of a circulation duct and a base in a machine room of a laundry treating apparatus of the present disclosure.

FIG. 6 shows structures of a circulation duct and a base in a machine room of a laundry treating apparatus of the present disclosure.

The base 310 may form a bottom surface of the laundry treating apparatus.

The base 310 may include a base bottom 311 forming a support surface. The base bottom 311 may form the bottom surface of the laundry treating apparatus.

In one example, the base bottom 311 may be seated on a top surface of the bottom surface of the cabinet 100 separately disposed to form the bottom surface of the laundry treating apparatus.

The base 310 may be integrally formed with the circulation duct 320 that forms at least a portion of the flow channel through which air flows. The circulation duct 320 may be formed by extending upward from the base bottom 311.

The circulation duct 320 may include a duct body 321 that extends from the base bottom 311 to form the flow channel, a heat exchanger installation portion 3212 that provides a space in which an evaporator 341 or a condenser 342 is installed inside the duct body 321, and an air discharger 323 that is disposed at the rear of the duct body 321 and discharges air in the duct body 321 to the blower 350.

The air discharger 323 may be formed in a pipe shape that extends rearward from the duct body 321. A diameter of the air discharger 323 may be smaller than a width of the duct body 321.

The air discharger 323 may be connected to the blower 350. Air discharged from the air discharger 323 may be guided into the inner casing 200 via the blower 350.

The circulation duct 320 may further include an outside air intake portion 322 defined by extending through a front surface of the duct body 321. The outside air intake portion 322 may be in communication with the outside air duct 370. The outside air duct 370 may be seated and supported in front of the outside air intake portion 322.

The circulation duct 320 may be installed with a damper that opens and closes the outside air intake portion 322. Opening and closing of the damper may allow or block inflow of outside air into the circulation duct 320.

The base 310 may include a compressor installation portion 312 that provides a space in which the compressor 343 is installed. The compressor installation portion 312 may be formed at one side of the base bottom 311 and may be formed integrally with the base bottom 311.

The compressor installation portion 312 may also have a protrusion formed that may support the compressor 343. The compressor installation portion 312 may be disposed to be biased to a rear side of the base 310. The compressor installation portion 312 may be disposed to at least partially overlap the air discharger 323 in a width direction.

A buffer member that reduces vibration transmitted from the compressor 343 may be installed in the compressor installation portion 312. The buffer member may be fixed to the protrusion.

The base 310 may include the compressor installation portion 312 in which the compressor 343, which supplies the refrigerant to the heat exchanger 341 and 343, is installed. The compressor installation portion 312 may be disposed outside the circulation duct 320.

The iron module S may be seated on the compressor installation portion 312 or at one side of the base 310. The iron module S may also be seated on the base 310. For example, the base bottom 311 may extend from the circulation duct 320 to edges of both side surfaces of the machine room 300, and the iron module S may be seated on the base bottom 311.

In addition, the iron module S may be installed in the machine room 300 by being disposed outside the base bottom 311. That is, the base bottom 311 may have a smaller area size than the bottom surface of the machine room 300, and the iron module S may form the remaining bottom surface of the machine room 300.

Figure 7:
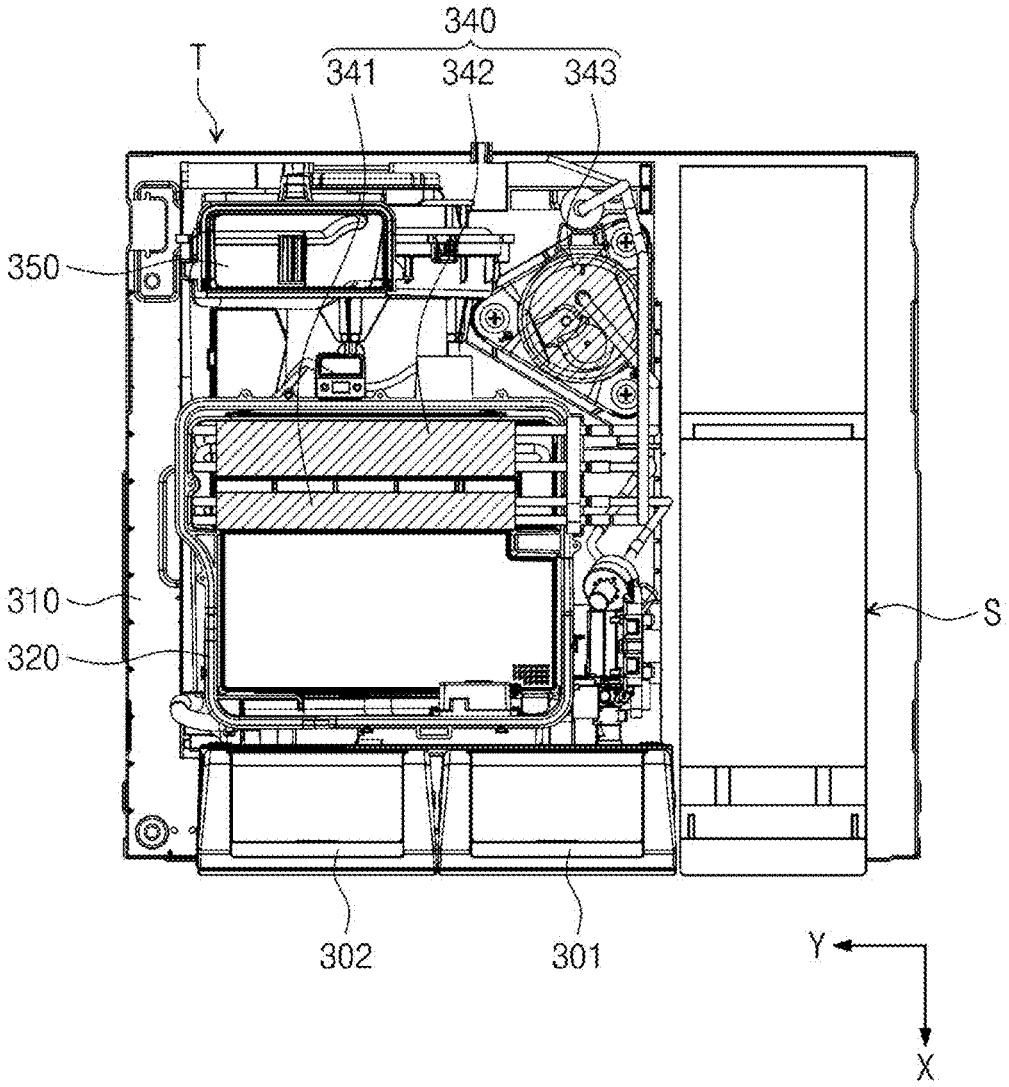
FIG. 7 shows inside of a circulation duct of a laundry treating apparatus of the present disclosure.

FIG. 7 shows inside of a circulation duct of a laundry treating apparatus of the present disclosure.

The circulation duct 320 may extend upward from the base bottom to form the flow channel through which air flows.

The heat supply part 340 may include the evaporator 341 that cools and condenses air flowing along the circulation duct 320, the compressor 343 that receives the refrigerant from the evaporator 341 and compresses and heats the refrigerant, and the condenser 342 that receives the refrigerant from the compressor 343 and heats air flowing along the circulation duct 320.

The heat supply part 340 may further include an expansion valve that expands the refrigerant that has passed through the condenser 342 to lower a temperature of the refrigerant.

The heat supply part 340 may include the evaporator 341 that is installed inside the circulation duct 320 and is equipped as a heat exchanger that cools and dehumidifies air that has been introduced into the circulation duct 320, the condenser 342 that is equipped as a heat exchanger that heats air that has passed through the evaporator 341 to generate hot air, the compressor 343 that supplies the refrigerant that exchanges heat with air to the condenser 342 and is disposed outside the circulation duct 320, and an expansion valve 344 that expands and cools the refrigerant that has passed through the condenser 342.

The evaporator 341 and the condenser 342 may be disposed inside the circulation duct 320, and the compressor 343 may be disposed outside the circulation duct 320.

The circulation duct 320 may include the heat exchanger installation portion 3212 that provides a space in which the evaporator 341 and the condenser 342 are installed. The heat exchanger installation portion 3212 may be defined inside the duct body 321.

The duct body 321 may have an open top surface. The condenser 343 and the evaporator 341 may be introduced via the opening of the duct body 321 and installed.

The opening of the duct body 321 may be shielded by the base cover 360, and the base cover 360 and the duct body 321 may form a flow channel through which air flows inside the circulation duct 320.

A front surface of the duct body 321 may be disposed to be spaced rearwardly apart from a front end of the base bottom 311. As a result, the base bottom 311 may secure a support surface 3111 on which at least one of the water supply tank 301, the drainage tank 302, and the outside air duct 370 described above is installed and supported.

In one example, as the duct body 321 is integrally formed with the base 310, a height of the heat exchanger installation portion 3212 may be secured greater and heights of the condenser 342 and the evaporator 341 may also be increased to that extent accordingly.

As a result, widths in the front and rear direction of the condenser 342 and the evaporator 341 may be reduced, so that the number of refrigerant pipes passing through the condenser and the evaporator may be reduced. In addition, an effect of reducing a flow loss of air passing through the condenser and the evaporator is derived.

In one example, a sum of a length of the evaporator 341 and a length of the condenser 342 may be smaller than a length of the heat exchanger installation portion 3212. Accordingly, the length in the front and rear direction of the heat exchanger installation portion 3212 may be equal to or smaller than half of the length of the duct body 321.

The blower 350 may be disposed to overlap the condenser 342 or the evaporator 341 in the front and rear direction. Therefore, air that has passed through the evaporator 341 and the condenser 342 may be introduced into the blower 350 without bending of the flow channel. That is, in a process in which air introduced into the circulation duct 320 flows to the blower 350, because there is no bending in the flow channel, the flow loss may be minimized.

A length of the iron module S may be greater than a length of the circulation duct 320.

Figure 8A:
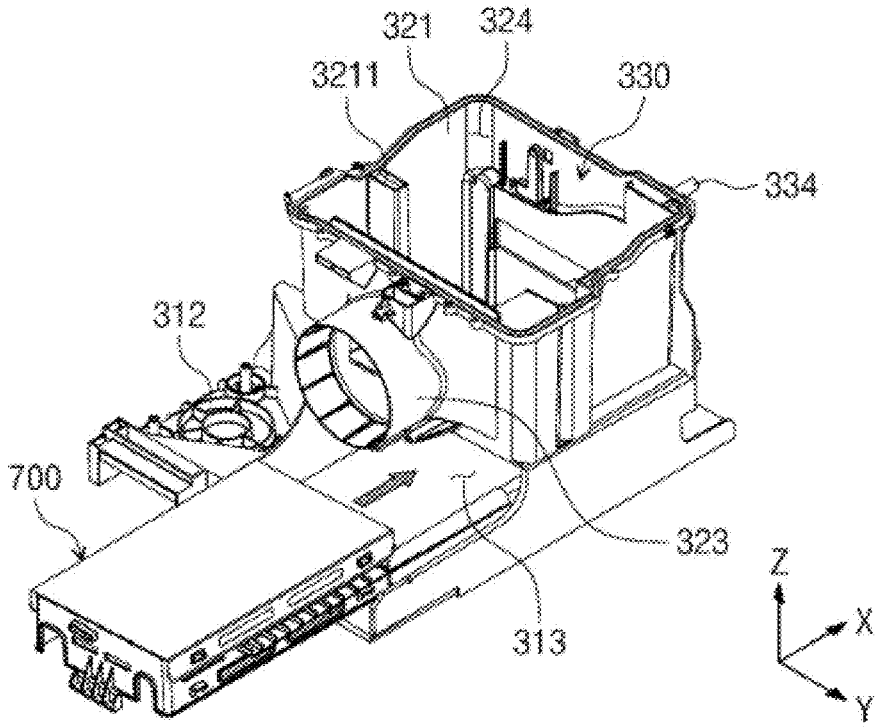
FIGS. 8A and 8B show a structure of a controller installation portion disposed on a base of a laundry treating apparatus of the present disclosure.
Figure 8B:
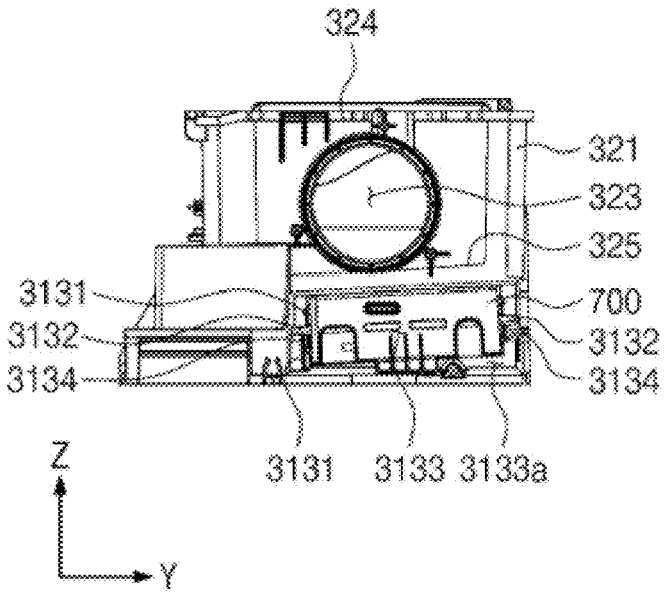

FIGS. 8A and 8B show a structure of a controller installation portion disposed on a base of a laundry treating apparatus of the present disclosure.

The refreshing module T may further include a main controller 700 that supplies power to the heat supply part 340 and the heating part 800 or controls the heat supply part 340 and the heating part 800.

The main controller 700 may be disposed inside the machine room 300. As a result, a volume of the inner casing 200 may be secured to the maximum.

The main controller 700 may be seated on the base 310.

The main controller 700 may be disposed outside the circulation duct 320.

For example, the main controller 700 may be disposed on a left or right side of the circulation duct 320.

For example, the base 310 may be equipped with a controller installation portion 313 that defines a space in which the main controller 700 may be inserted under the circulation duct 320.

The base 310 may include the controller installation portion 313 in which the main controller 700 is installed. The controller installation portion 313 may be formed between the base bottom 311 and the circulation duct 320. The controller installation portion 313 may be formed between the base bottom 311 and a bottom surface of the circulation duct 320. The controller installation portion 313 may be formed in a duct shape with one of a front surface and a rear surface opened, under the circulation duct 320.

The main controller 700 may be connected to an external power source and supplied with the power, and may supply the power to all electronically controlled components such as the compressor 343, the heating part 2100, and the blower fan 353.

In addition, the main controller 700 may be equipped to control all of the electronically controlled components such as the compressor 343, the heating part 2100, and the blower fan 353, and may perform various courses and options for treating the laundry.

When the main controller 700 is inserted into and supported in the controller installation portion 313, vibration or impact applied to the main controller 700 may be buffered. In addition, because the main controller 700 is disposed close to the electrical components constituting the refreshing module T, occurrence of control errors such as noise may be minimized.

The circulation duct 320, the outside air duct 370, the main controller 700, and the heat supply part 340 may be installed in a modular manner on the base 310. Accordingly, the base 310 may be easily installed and maintained by being extended forward from and retracted rearward into the machine room 300.

FIG. 8A shows an embodiment in which the main controller 700 is installed in the controller installation portion 313.

The main controller 700 may be equipped as a PCB panel, but may not be limited thereto and may be equipped as various devices for control.

The main controller 700 may be inserted into and seated in the controller installation portion 313 disposed under the circulation duct 320. The bottom surface of the circulation duct 320 may form a top surface of the controller installation portion 313. The controller installation portion 313 may be disposed downward of the air discharger 323.

The controller installation portion 313 may be formed integrally with the base bottom 311. The controller installation portion 313 may be defined as a recessed space under the circulation duct during a process of molding the circulation duct 320 on the base 310.

The main controller 700 may be slidably retracted forward into the controller installation portion 313.

A bracket 3131 may be further disposed on a surface of the main controller 700 to surround the controller. The brackets 3131 may be disposed on an upper portion and a lower portion of the controller to prevent the foreign substances from entering the controller.

In addition, the bracket 3131 may prevent a circuit board inside the main controller 700 from being damaged by heat or vibration transmitted to the main controller 700. The bracket 3131 may be made of a metal material.

FIG. 8B shows a state in which a controller is installed in a controller installation portion.

As shown in the drawing, the main controller 700 may be installed at a predetermined angle with the base bottom 311. For example, the main controller 700 may be disposed to be inclined toward the reservoir 326. Accordingly, when water leaks from the upper portion of the main controller 700, water may quickly escape the main controller 700.

The main controller 700 may include a supporter 3132 that is formed to protrude from a side surface thereof.

The controller installation portion 313 may include ribs 3134 that protrude from both side surfaces of the installation portion, respectively. The supporter 3132 of the controller may be mounted on the rib 3134.

The supporter 3132 of the controller may support an entire load of the main controller 700. When the supporter 3132 of the controller is supported on the rib 3134, the main controller 700 may be spaced apart from the base bottom 311 by a predetermined distance.

The rib 3134 may be formed integrally with the base 310. The rib 3134 may be molded together with the base 310 when the base 310 is injection-molded, and may be formed integrally with the components such as the base bottom 311, the circulation duct 320, and the like.

A protrusion 3133 may be formed so as to protrude on a front surface of the main controller 700. In addition, a guide protruding rearward may be disposed on an inner surface of the controller installation portion 313. The protrusion may be coupled with the guide. The protrusion may be inserted into the guide. When the controller is introduced into the controller installation portion, the controller may be aligned at a correct location by coupling the protrusion to the guide.

In addition, locations of both side surfaces of the controller may be determined in such a way that the supporter is seated on the rib as described above. With such coupling process, the controller may be coupled at the correct location of the controller installation portion without a separate fastening member.

Figure 9:
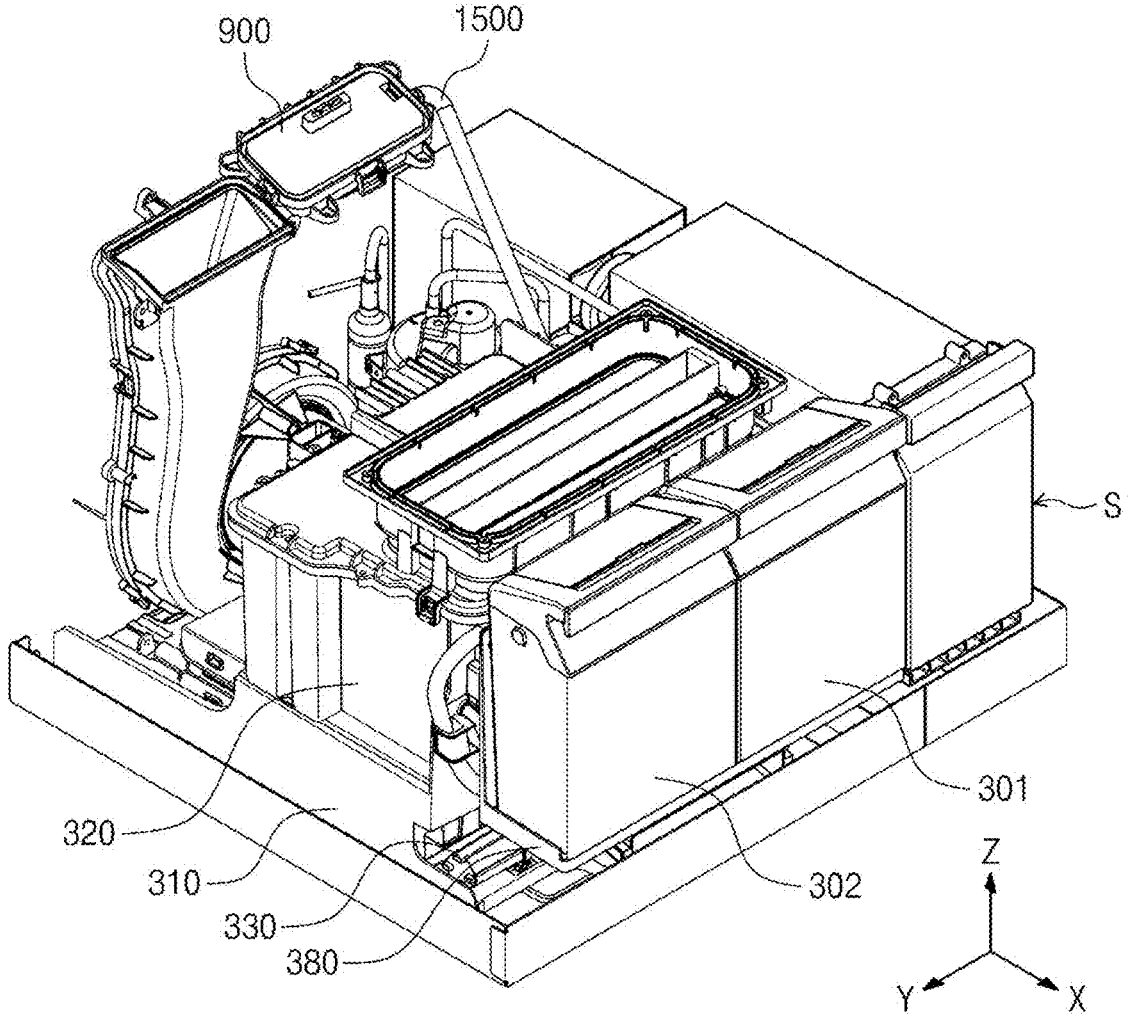
FIG. 9 shows a water supply and drainage system of a laundry treating apparatus of the present disclosure.

FIG. 9 shows a water supply and drainage system of a laundry treating apparatus of the present disclosure.

The laundry treating apparatus of the present disclosure may include the water supply tank 301 that supplies water to the heating part 2100 and the drainage tank 302 that collects condensed water from the circulation duct 320 or the steam iron 1300 and the cable 1400.

The water supply tank 301 and the drainage tank 302 should be selectively separated from each other in the machine room 300 for the user to easily fill the water supply tank 301 with water and discard water collected in the drainage tank 302.

The machine room 300 may further include a detachment portion 380 disposed in front of the refreshing module T to support the water supply tank 301 and the drainage tank 302. The detachment portion 380 may be detachably coupled to the water supply tank 301 and the drainage tank 302.

The detachment portion 380 may be formed in a plate shape to prevent the inside of the machine room 300 from being exposed.

A drainage pump 331 or the like may be disposed under the detachment portion 380, and the circulation duct 320 may be disposed at the rear of the detachment portion 380.

A portion of the iron module S may extend through the detachment portion 380.

The iron module S may be disposed on one side of one of the water supply tank 301 and the drainage tank 302. The iron module S may not be disposed between the water supply tank 301 and the drainage tank 302. As a result, a length in the front and rear direction of the iron module S may be sufficiently secured.

The iron module S may be disposed closer to the water supply tank 301 than to the drainage tank 302. Accordingly, water may be easily supplied from the water supply tank 301, heated, and delivered to the steam iron 1300, a structure for receiving water from the water supply tank 301 may be simply designed, and a volume occupied by the structure may be minimized.

Figure 10:
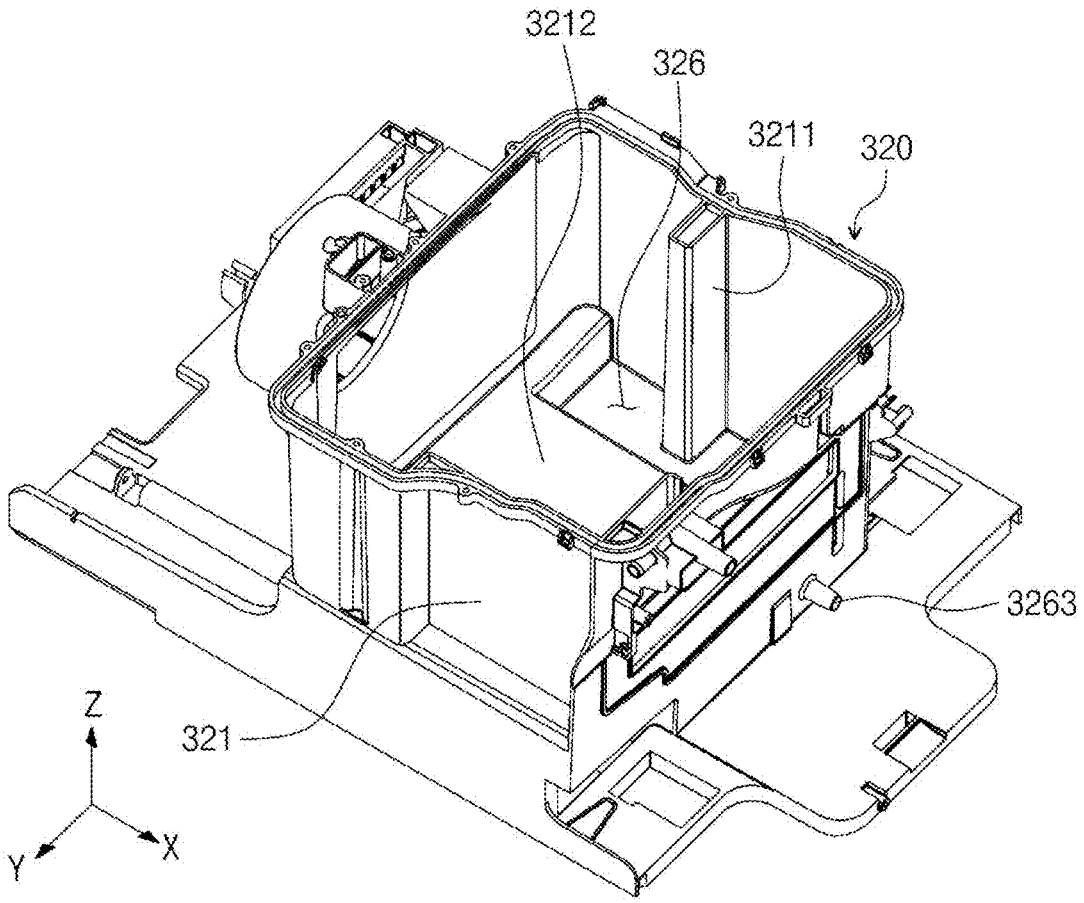
FIG. 10 shows a drainage structure of a laundry treating apparatus of the present disclosure.

FIG. 10 shows a drainage structure of a laundry treating apparatus of the present disclosure.

In the laundry treating apparatus of the present disclosure, when the compressor 343 and the blower fan 353 are operated, air supplied from the outside of the cabinet 100 and air supplied from the inner casing 200 are cooled while passing through the evaporator 341, and water vapor contained in the air is condensed.

Water condensed in the evaporator 341 may accumulate on the bottom surface of the circulation duct 320.

The laundry treating apparatus of the present disclosure may include a reservoir 326 defined as a portion of the bottom surface of the duct body 321 is recessed to collect condensate condensed in the evaporator 341.

The reservoir 326 is a space defined as the portion of the bottom surface of the duct body 321 is recessed, and is able to form one side surface of a controller installation portion 313.

The reservoir 326 may be defined to be recessed downward from the bottom surface of the circulation duct 320.

The reservoir 326 may be formed integrally with the circulation duct 320. The reservoir 326 may be formed by forming the portion of the bottom surface of the circulation duct 320 to be recessed while injection-molding the circulation duct 320 onto the base 310.

The reservoir 326 may have at least a portion of a top surface thereof disposed parallel to the heat exchanger installation portion 3212.

The base 310 may include a guide pipe 3263 that discharges water collected in the reservoir 326 to the outside.

The guide pipe 3263 may protrude from a lower portion of the reservoir 326 to the outside of the circulation duct 320. The guide pipe 3263 may discharge water stored in the reservoir to the outside of the base. This may prevent water collected in the reservoir 326 from decaying or flowing back to the bottom surface of the circulation duct 320.

The circulation duct 320 may include a partition wall 3211 that extends from an inner surface of the duct body 321. The partition wall 3211 may protrude inwardly from an inner wall of the circulation duct 320, or an outer wall of the circulation duct 320 may be recessed inward and protrude inward. The partition wall 3211 may guide a location where the heat exchanger 341 and 343 is installed, and may prevent air entering the heat exchanger from passing by bypassing the heat exchanger. The partition wall 3211 may be disposed in the reservoir 326.

Figure 11:
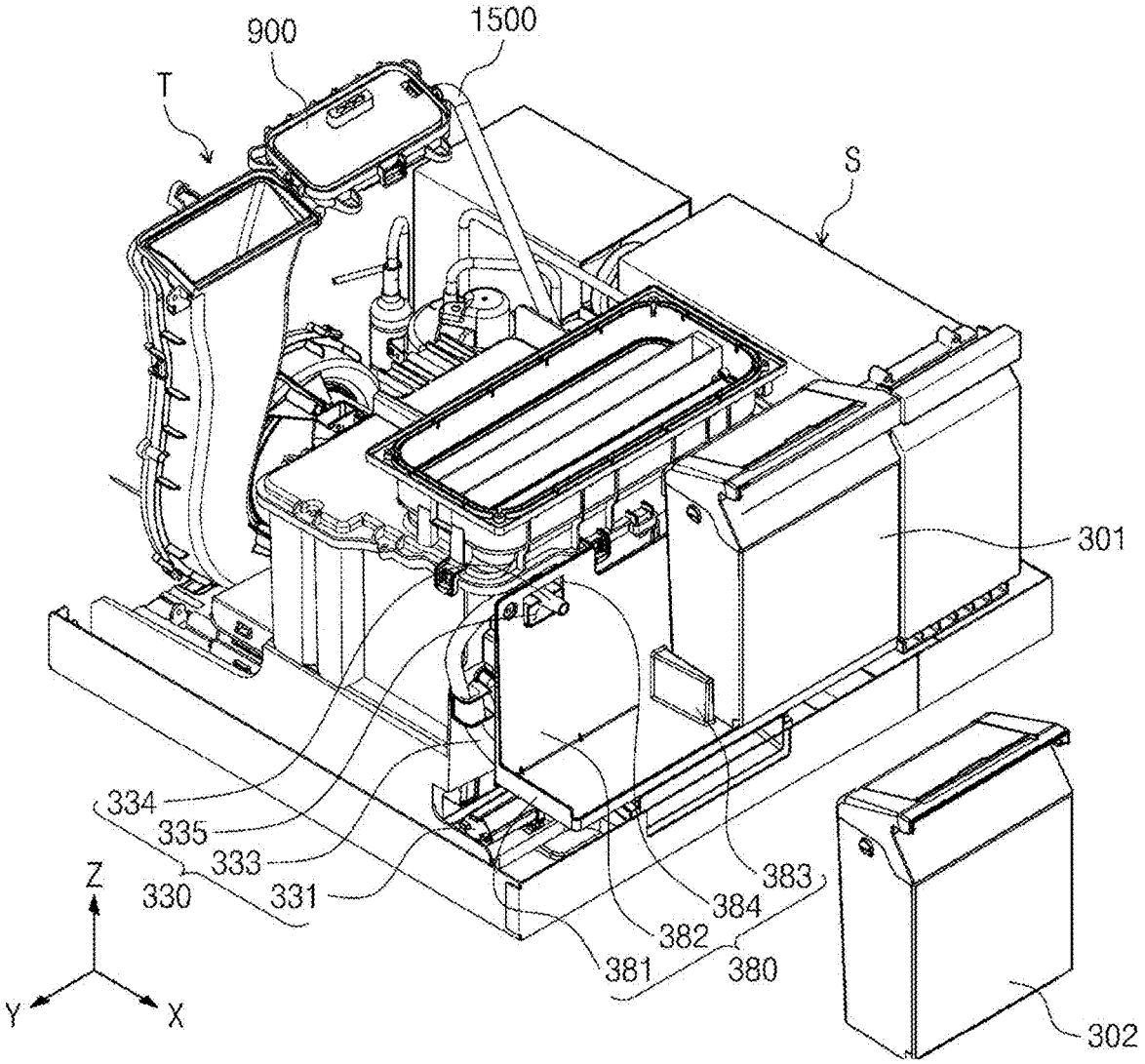
FIG. 11 shows a drainage tank installation structure of a laundry treating apparatus of the present disclosure.

FIG. 11 shows a drainage tank installation structure of a laundry treating apparatus of the present disclosure.

The drainage tank 302 may be formed in a shape of a box that stores water.

The drainage tank 302 may include a supply hole for receiving water defined in a rear surface, and the supply hole may be defined closer to an upper end than to the bottom surface of the drainage tank 302.

The detachment portion 380 may include a load support 381 on which at least one of the drainage tank 302, the water supply tank 301, and the iron module S may be supported, and a detachment support 382 disposed on the load support 381 in front of the circulation duct 320 and on which the drainage tank 302 and the water supply tank 301 may be seated.

The load support 381 may be formed in a plate shape to support bottom surfaces of the water supply tank 301 and the drainage tank 302, and the detachment support 382 may also be formed in a plate shape to support rear surfaces of the water supply tank 301 and the drainage tank 302.

The detachment portion 380 may include a detachment separator 383 protruding from the load support 381 so as to be disposed between the water supply tank 301 and the drainage tank 302. The detachment separator 383 may separate the water supply tank 301 and the drainage tank 302 from each other by a predetermined spacing. As a result, when one of the water supply tank 301 and the drainage tank 302 is withdrawn, the other of the water supply tank 301 and the drainage tank 302 may be prevented from being withdrawn arbitrarily.

The laundry treating apparatus of the present disclosure may further include a drainage 330 that collects water condensed in the circulation duct 320 into the drainage tank 302.

The drainage 330 may include the drainage pump 331 that receives water from the guide pipe 3263 and a drainage hose 333 that receives water from the drainage pump 331 and guides water to the drainage tank 302.

The drainage 330 of the present disclosure may further include a discharge pipe 334 that allows the drainage hose 333 and the drainage tank 302 to be in communication with each other. The discharge pipe 334 may receive water from the drainage hose 333 and guide water into the drainage tank 302.

In one example, the discharge pipe 334 may be directly connected to the drainage hose 333 or may be formed integrally with the drainage hose 333.

However, the laundry treating apparatus of the present disclosure may install the discharge pipe 334 in the circulation duct 320 such that water may be continuously supplied even when a water level inside the drainage tank 302 reaches a full level, and the circulation duct 320 may be constructed to receive water flowing back from the discharge pipe 334 or the drainage tank 302 again therein.

As a result, the circulation duct 320 and the reservoir 326 may temporarily perform the role of the drainage tank 302 to expand a water storage capacity. As a result, water may be prevented from overflowing out of the drainage tank 302.

For example, the detachment portion 380 may include a detachment communication portion 384 that is defined to extend through the detachment support 382 so as to allow the drainage hose 333 and the drainage tank 302 to be in communication with each other.

The detachment communication portion 384 may be defined in an area facing the supply hole defined in the drainage tank when the drainage tank 302 is seated on the load support 381.

The discharge pipe 334 may extend from the circulation duct 320 or may extend from the detachment portion 380. The discharge pipe 334 may be formed as an injection-molded product. Accordingly, the discharge pipe 334 may stably fix a distal end of the drainage hose 333 and prevent the drainage hose 333 from being bent abruptly.

In addition, the discharge pipe 334 may be formed as an injection-molded product in a shape of a pipe fixed to the circulation duct 320 or the support 381, so that an installation location thereof may always be fixed. Accordingly, a distal end of the discharge pipe 334 and the supply hole defined in the drainage tank 302 are always positioned in correct locations, so that condensate supplied from the drainage pump 331 may be stably introduced into the drainage tank 302.

The laundry treating apparatus of the present disclosure may further include a backflow portion 335 that allows water contained inside the drainage tank 302 to flow back into the circulation duct 320 or the drainage 330.

The backflow portion 335 may be formed under the discharge pipe 334 and may allow the circulation duct 320 and the inside of the drainage tank 302 to be in communication with each other. The backflow portion 335 may receive water inside the drainage tank 302 and guide water into the circulation duct 320.

Figure 12:
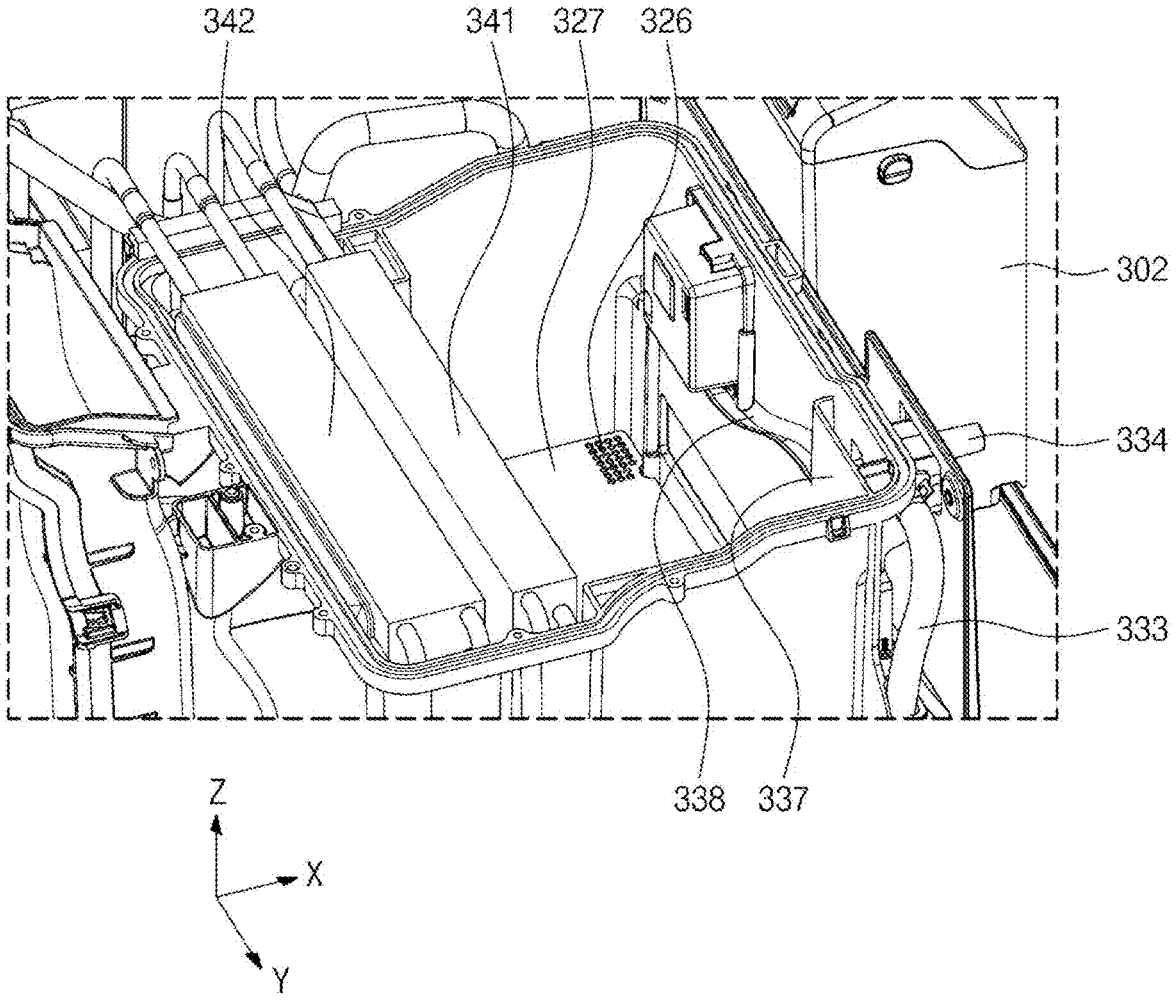
FIG. 12 shows in detail a structure of a backflow portion of a laundry treating apparatus of the present disclosure.

FIG. 12 shows in detail a structure of a backflow portion of a laundry treating apparatus of the present disclosure.

The circulation duct 320 may have the evaporator 341 and the condenser 342 disposed therein. In this regard, the evaporator 341 may be disposed in front of the condenser 342 in the circulation duct 320.

The backflow portion 335 may be defined in a front surface of the circulation duct 320. In this regard, when water introduced into the circulation duct 320 from the backflow portion 335 comes into contact with the evaporator 341 or the like, the evaporator 341 may be unnecessarily corroded or contaminated and an efficiency of the evaporator 341 in cooling air may decrease.

Therefore, to prevent water supplied from the backflow portion 335 from coming into contact with the evaporator 341 along air directed toward the evaporator 341, the evaporator 341 may be disposed closer to a rear side of the circulation duct 320 than the backflow portion 335.

The backflow portion 335 or the discharge pipe 334 may be exposed forward of the circulation duct 320 by extending through the detachment communication portion 384. When the drainage tank 302 is seated on the detachment support 382, a distal end of the backflow portion 335 or the discharge pipe 334 may be inserted into the drainage tank 302.

As a result, water discharged out of the circulation duct 320 via the drainage pump 331 may be collected in the drainage tank 302 along the drainage hose 333 and the discharge pipe 334.

When the water level of the drainage tank 302 reaches the discharge pipe 334 or the backflow portion 335, water overflowing out of the backflow portion 335 may be introduced into the circulation duct 320 again along the backflow portion 335 and be prevented from leaking out of the machine room 300.

A guide flow channel 338 may extend along a width direction of the front surface of the circulation duct 320. One end of the guide flow channel 338 may be disposed to be in communication with the backflow portion 335, and the other end thereof may be disposed above the reservoir 326.

In addition, the circulation duct 320 may further include a blocking wall 337 that guides water introduced from the backflow portion 335 to the guide flow channel 338.

Figure 13:
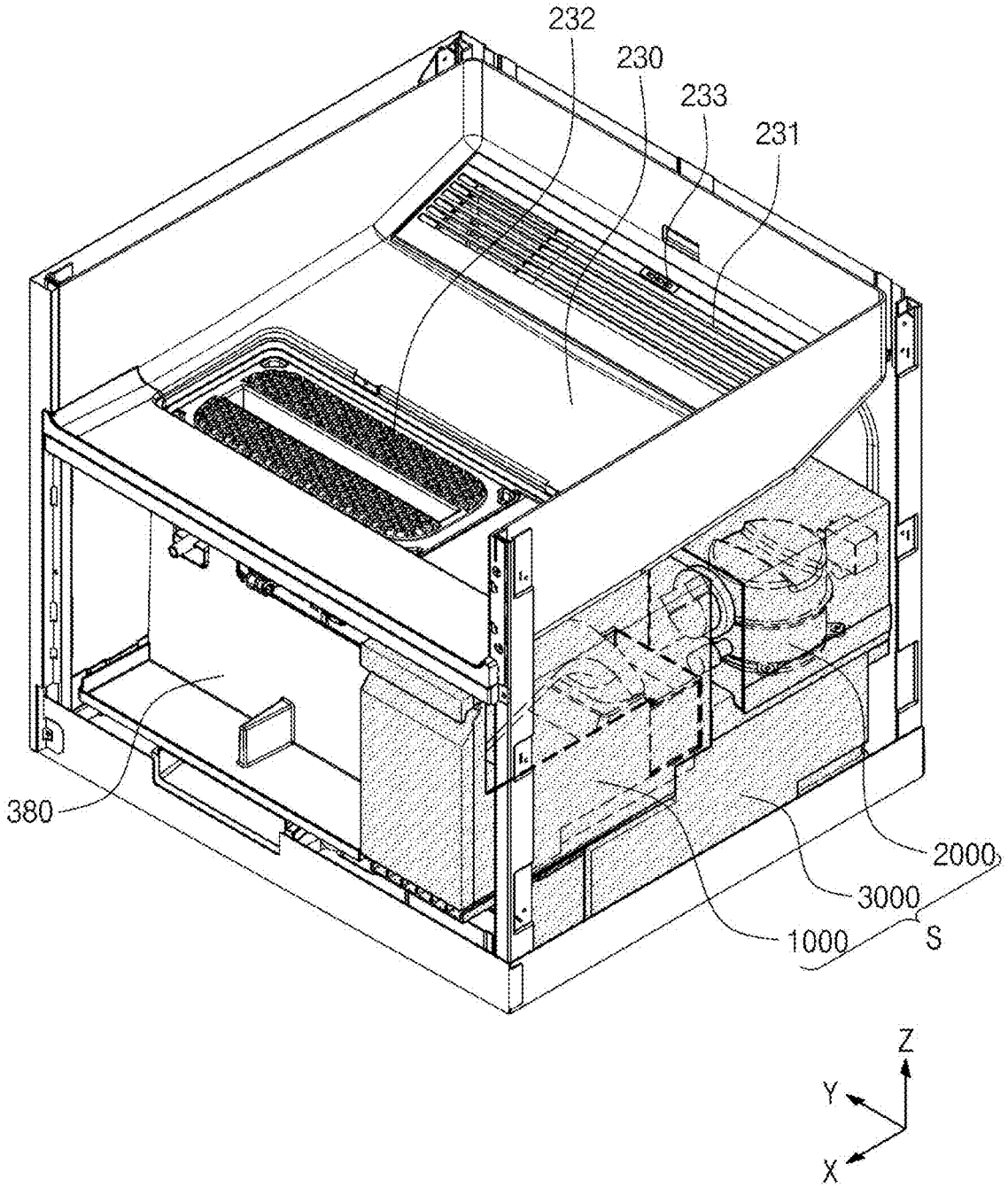
FIG. 13 shows a lower configuration of a bottom surface of an inner casing.

FIG. 13 shows a lower configuration of a bottom surface of an inner casing.

The bottom surface 230 may introduce air inside the inner casing 200 into the circulation duct 320 via the inflow hole 232, and may receive air dehumidified and heated while passing through the circulation duct 320, via the exhaust hole 231. In addition, steam supplied from the heating part 800 may be received via the steam hole 233.

However, the bottom surface 230 except for the through-holes may block air, moisture, and foreign substances inside the inner casing 200 from flowing out into the machine room 300.

The detachment portion 380 may be disposed in a front side of the machine room 300 to prevent external air, moisture, and foreign substances from being introduced into the machine room 300.

The laundry treating apparatus of the present disclosure may install the iron module S in the machine room 300. As a result, the iron module S may be prevented from being exposed to air, moisture, and the foreign substances inside the inner casing 200.

In addition, the machine room 300 may have the entire components disposed under the bottom surface 230, so that the machine room 300 may be disposed and installed independently of the inner casing 200. As a result, the machine room 300 may be manufactured as a module and installed in the cabinet 100.

The iron module S may be installed in the machine room 300 in a modular manner. Therefore, the iron module S may also be selectively installed in the machine room 300 without affecting the internal configurations of the machine room 300 and the cabinet 100.

Therefore, even when the laundry treating apparatus of the present disclosure is a product that does not have the iron module S, the iron module S may be installed in the machine room 300 in the future.

The iron module S may be disposed to one of both side surfaces of the machine room 300. The iron module S may minimize interference with existing components such as the circulation duct 320.

The iron module S may further include a storage module 1000 that may store the steam iron 1300, which supplies at least one of heat and steam to the laundry, inside the machine room 300, and a heating module 2000 including the heating part 2100, which generates at least one of heat and steam supplied to the steam iron 1300.

The heating module 2000 may be disposed at the rear of the storage module 1000, and the storage module 1000 may be exposed forwardly of the machine room 300. Accordingly, the steam iron 1300 may be withdrawn forwardly of the machine room 300 so as to be accessible to the laundry.

The detachment portion 380 may have a pass-through surface that supports the steam iron 1300 so as to be withdrawn forward from inside the machine room 300.

The iron module S may further include a base module 3000 that supports the storage module 1000 and the heating module 2000. The base module 3000 may provide a space in which the storage module 1000 and the heating module 2000 are installed, and may fix the locations and a connected state of the storage module 1000 and the heating module 2000.

In addition, the base module 3000 may place the storage module 1000 and the heating module 2000 at a predetermined vertical level or higher from the base 310 or the bottom surface of the cabinet.

Therefore, water or residual water condensed in the storage module 1000 and the heating module 2000 may be naturally discharged by gravity, and the storage module 1000 and the heating module 2000 may be prevented from being damaged by vibration or impact.

The storage module 1000 and the heating module 2000 may be mounted on the base module 3000 and installed inside the machine room 300.

In one example, when the storage module 1000 and the heating module 2000 may be stably installed in the machine room 300, the base module 3000 may be omitted.

Figure 14:
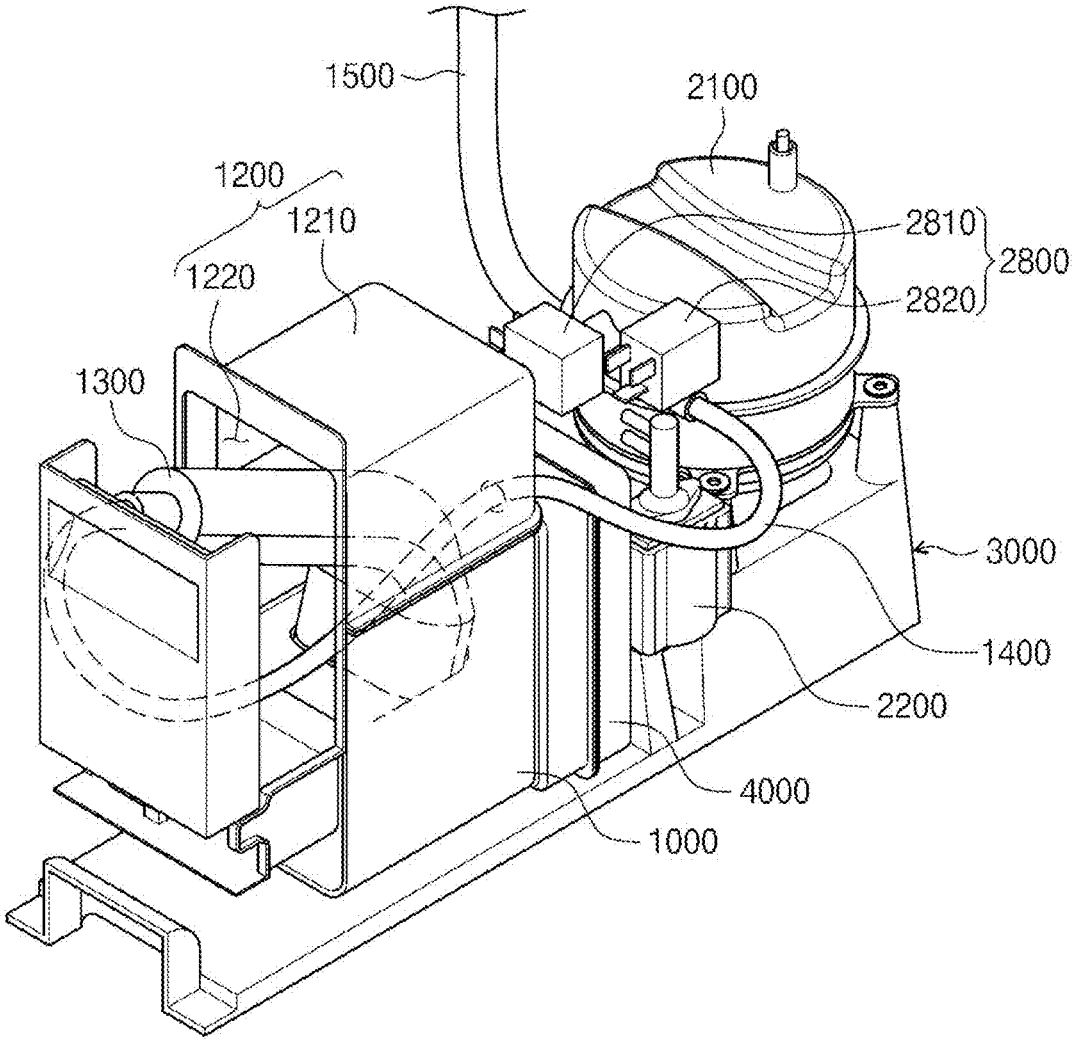
FIG. 14 shows a structure of the iron module in detail.

FIG. 14 shows a structure of the iron module in detail.

The storage module 1000, the heating module 2000, and the base module 3000 may be manufactured integrally or may be manufactured separately and then coupled and fixed to each other.

A following description is based on the assumption that the storage module 1000, the heating module 2000, and the base module 3000 are equipped as independent modules, but it does not exclude that they are manufactured integrally.

The storage module 1000, the heating module 2000, and the base module 3000 may be manufactured independently of each other and installed in the machine room 300. Accordingly, the storage module 1000, the heating module 2000, and the base module 3000, which have volumes smaller than the volume of the entire iron module S, may be sequentially installed in the machine room 300, so that work of installing the iron module S in the machine room 300 may be easy.

In addition, when one of the storage module 1000, the heating module 2000, and the base module 3000 is damaged or defective, only the specific module needs to be replaced or repaired, so that the maintenance and repair of the iron module S may be easy.

The storage module 1000 may include the steam iron 1300 that may access the laundry and supply at least one of heat and steam to the laundry. The steam iron 1300 may have a surface, which faces the laundry, made of a material capable of transmitting heat, and thus, may remove wrinkles from the laundry when being in contact with the laundry.

In addition, the steam iron 1300 may have a spray hole through which steam is sprayed in the surface facing the laundry, so that high-temperature steam may be supplied to the surface of the laundry to not only remove the wrinkles from the laundry, but also perform the refreshing cycle such as sterilization and deodorization of the laundry.

The steam iron 1300 may be equipped to generate heat and steam by being supplied with power on its own, but may also be equipped to receive at least one of heat and steam from the heating module 2000 and transmit the same.

When the steam iron 1300 is equipped to receive at least one of heat and steam, a weight and a volume of the steam iron 1300 are reduced, so that the user may easily lift the steam iron 1300 up to the surface of the laundry hung on the hanger or fixer.

The storage module 1000 may further include the storage 1200 that accommodates the steam iron 1300 therein. The storage 1200 may be formed in a casing shape that has an accommodating space for storing the steam iron 1300 therein.

The storage 1200 may serve to store the steam iron 1300 inside the machine room 300, and may serve to arbitrarily change the location where the steam iron 1300 is stored inside the machine room 300.

A width of the storage 1200 may be greater than a width of the steam iron 1300, and a length of the storage 1200 may be greater than a length of the steam iron 1300.

For example, the width of the storage 1200 may be approximately 1 to 3 cm greater than the width of the steam iron 1300. However, the width of the storage 1200 may not be greater than the width of the steam iron 1300 by 5 cm or more. This may prevent the steam iron 1300 from vibrating or moving in the left and right direction inside the storage 1200.

The storage 1200 may have the length in the front and rear direction greater than the width in the left and right direction, and a height in the vertical direction greater than the width in the left and right direction. As a result, the steam iron 1300 may be stably inserted and stored inside the storage 1200.

The storage 1200 may include a storage body 1210 that accommodates the steam iron 1300 therein, and an open surface 1220 defined at a front side of the storage body 1210 and through which the steam iron 1300 may be withdrawn.

The storage body 1210 may accommodate the steam iron 1300 therein so as to block the steam iron 1300 from being exposed through the top surface, both side surfaces, and the rear surface of the machine room.

The storage body 1210 may accommodate and withdraw the steam iron 1300 only through the open surface 1220. As a result, the steam iron 1300 may be exposed only forwardly of the machine room 300, and may be prevented from being exposed or withdrawn in other directions.

The open surface 1220 may open the entire front side of the storage body 1210. As long as the steam iron 1300 is able to be withdrawn and inserted, the open surface 1220 may open only a portion of the front surface of the storage body 1210.

The storage module 1000 may further include a drawer that is extended forwardly of the storage 1200 to expose the steam iron 1300.

In addition, as shown, the storage module 1000 may further include a cover door 1130 that is pivotable forward from the storage body 1210 or the base module 3000 and opens the open surface 1220.

An independent controller 4000 that controls the iron module S independently of the refreshing module T may be disposed at the rear of the storage module 1000. The independent controller 4000 will be described later.

The heating module 2000 may include the heating part 2100 that receives water from the water supply tank 301, supplies steam to the steam iron 1300, and also supplies steam to the inner casing 200.

The heating part 2100 may receive power, heat water, generate steam, and then transmit heat to the steam iron 1300 via the cable 1400.

For example, the heating part 2100 may be equipped as a steam generator that receives power and water to generate steam.

In addition, the heating part 2100 may supply steam to the steam iron 1300 via the valve assembly 2800, the cable 1400, and the guide pipe 1500, and may also supply steam into the inner casing 200.

The heating part 2100 may include an outlet 2110 through which steam is discharged.

The valve assembly 2800 may open and close the outlet 2110, or selectively control flow of steam discharged from the outlet 2110 to the cable 1400 or the guide pipe 1500.

The valve assembly 2800 opening the guide pipe 1500 may mean a series of states of setting the guide pipe 1500 in a state of being in communication with the heating part 2100 and being able to receive steam, and the valve assembly 2800 closing the guide pipe 1500 may mean a series of states of setting the guide pipe 1500 in a state in which the communication with the heating part 2100 is blocked and steam is not able to be received.

For example, the valve assembly 2800 may include directly opening and closing the guide pipe 1500, or indirectly opening and closing the guide pipe 1500 by opening and closing the outlet, a separate branch pipe, or the like of the heating part.

The valve assembly 2800 opening the cable 1400 may mean a series of states of setting the cable 1400 in a state of being in communication with the heating part 2100 and being able to receive steam, and the valve assembly 2800 closing the cable 1400 may mean a series of states of setting the cable 1400 in a state in which the communication with the heating part 2100 is blocked and steam is not able to be received.

For example, the valve assembly 2800 may include directly opening and closing the cable 1400, or indirectly opening and closing the cable 1400 by opening and closing the outlet, the separate branch pipe, or the like of the heating part.

The valve assembly 2800 may include a first valve 2810 that determines whether to supply steam to the inner casing 200, and a second valve 2820 that determines whether to supply steam to the steam iron 1300.

The guide pipe 1500 and the cable 1400 may be arranged completely spaced apart from each other from one end to the other end.

In addition, the first valve 2810 and the second valve 2820 may also be disposed completely spaced apart from each other. In this case, the first valve 2810 may be directly coupled to the guide pipe 1500 to open and close the guide pipe 1500, and the second valve 2820 may be directly coupled to the cable 1400 to directly open and close the cable 1400.

The valve assembly 2800 may be equipped as a solenoid valve and may be controlled by the main controller 700 or the independent controller 4000.

Regardless of where the valve assembly 2800 is coupled and disposed, the valve assembly 2800 may be controlled to close the cable 1400 when the guide pipe 1500 is opened, and to close the guide pipe 1500 when the cable 1400 is opened.

The valve assembly 2800 may be controlled to prevent the cable 1400 and the guide pipe 1500 from being in communication with the heating part 2100 at the same time. That is, the valve assembly 2800 may be controlled such that only one of the cable 1400 and the guide pipe 1500 is opened to be supplied with steam.

As a result, steam may be supplied intensively to only one of the cable 1400 and the guide pipe 1500, thereby securing a minimum amount of steam required for treating the laundry.

The heating part 2100 may be equipped as any component as long as it is able to receive water and heat steam. The heating part 2100 may include an accommodating body 2110 forming an outer appearance and a heater disposed inside the steam container to heat water.

In addition, the heating module 2000 may further include a water supply pump 2200 that supplies water stored in the water supply tank 301 to the heating part 2100.

The water supply pump 2200 may supply water to the heating part 2100 at a pressure higher than the atmospheric pressure. Accordingly, the heating part 2100 may generate steam while receiving water even when a pressure inside is equal to or higher than the atmospheric pressure.

Unlike the storage module 1000, the heating module 2000 may be prevented from being extended from the machine room 300. That is, when the heating module 2000 is installed in the machine room 300, it may be fixed inside the machine room 300. For example, the heating part 2100 may be mounted and fixed on the base module 3000.

Entire components of the heating module 2000 may be positioned rearward of the storage module 1000. As a result, exposure of the storage module 1000 forward of the machine room 300 and extension of the steam iron 1300 forward of the machine room may not be obstructed. In addition, the storage module 1000 may be prevented from being exposed rearwardly of the machine room 300.

The heating module 2000 may be mounted and fixed on the base module 3000 or the base 310. The heating module 2000 may be entirely accommodated in a heating casing 2700 such that the entire components of the heating module 2000 may be stably installed. The heating casing 2700 may have an open surface through which the cable 1400 may pass at a front side, and may be formed in a box shape in which both side surfaces and a top surface are not exposed to the outside.

Most of the components of the heating module 2000 may be installed inside the heating casing 2700. Therefore, maintenance and repair of the heating module 2000 may be easy.

The base module 3000 may include a base panel 3200 disposed parallel to the base 310, and a seating panel 3100 extended from the base panel 3200 and on which the storage module 1000 and the heating module 2000 are seated.

The base panel 3200 may be formed integrally with the base 310.

However, when the iron module S is equipped as a module independent of the circulation duct 320, the base panel 3200 may be formed separately from the base 310.

The seating panel 3100 may fix lower portions of the storage module 1000 and the heating module 2000, but space the storage module 1000 and the heating module 2000 apart from the base panel 3200 by a certain vertical dimension.

As a result, a space may be secured between the storage module 1000 and the heating module 2000, and the base panel 3200 in which a water supply structure connected to the cable 1400 or the heating module 2000 to supply water to the heating module 2000 and a drainage structure 2600 to discharge water from the heating module 2000 may be installed.

Furthermore, because the storage module 1000 and the heating module 2000 are disposed upward of the drainage structure 2600 by the seating panel 3100, condensate or residual water generated in the storage module 1000 and the heating module 2000 may be guided to the drainage structure without a separate power member.

The seating panel 3100 may extend upward from both side surfaces of the base panel 3200.

A rail 3300 that is coupled to an inner surface of the seating panel 3100 to extend the extendable portion 1110 may be coupled to the base module 3000.

Figure 15:
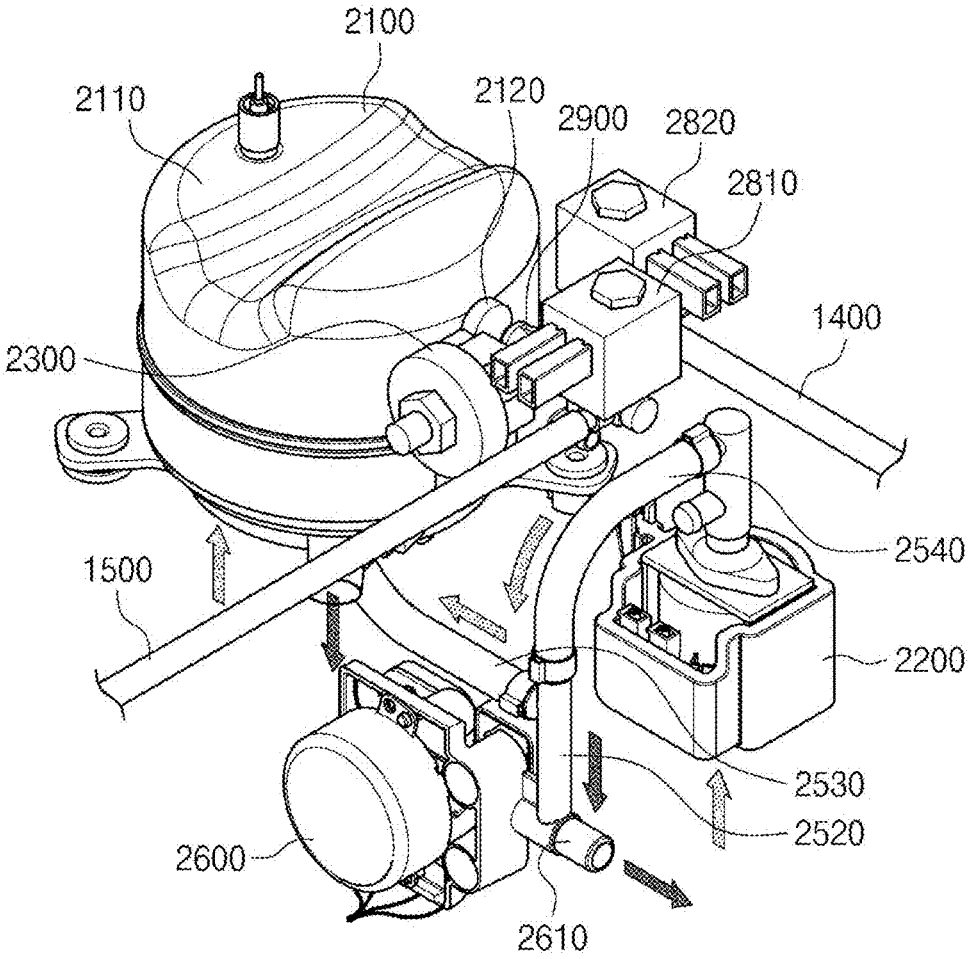
FIG. 15 shows a water supply and drainage structure of the heating module.

FIG. 15 shows a water supply and drainage structure of the heating module 2000.

For the heating part 2100 to generate steam and deliver the same to at least one of the steam iron 1300 and the inner casing 200, water needs to be supplied.

The water supply pump 2200 may be connected to the water supply tank 301 and receive water from the water supply tank 301.

In one example, the water supply pump 2200 may receive water from a separate water source other than the water supply tank and supply water to the heating part 2100.

In one example, the water supply pump 2200 may not simply supply water to the heating part 2100, but may supply water while increasing the pressure inside the heating part 2100.

The heating part 2100 may be equipped with a pressure sensor 2300 that measures the internal pressure.

The valve assembly 2800 may be controlled to determine opening and closing thereof based on the pressure inside the heating part 2100.

The heating part 2100 may include only one outlet 2120 through which steam is discharged. A branch pipe 2900 may be coupled to the outlet 2120, and the branch pipe 2900 may include a plurality of outlets to transmit steam to the guide pipe 1500 and the cable 1400.

Each of the guide pipe 1500 and the cable 1400 may be coupled and fixed to the branch pipe 2900.

The first valve 2810 and the second valve 2820 may be coupled to the branch pipe 2900 that is in communication with the guide pipe 1500 and may be in communication with each other.

The first valve 2810 and the second valve 2820 may selectively open and close the branch pipe 2900.

For example, the first valve 2810 may be coupled to the branch pipe 2900 and may selectively allow the branch pipe 2900 and the guide pipe 1500 to be in communication with each other to open and close the guide pipe 1500, and the second valve 2820 may be coupled to the branch pipe 2900 and may selectively allow the branch pipe 2900 and the cable 1400 to be coupled to each other to open and close the cable 1400.

The pressure sensor 2300 may be in communication with the outlet 2120 extending from the accommodating body 2110, and the valve assembly 2800 that opens and closes the outlet 2120 may be coupled.

The valve assembly 2800 may be controlled by the independent controller 4000 of the iron module S or the main controller 700 of the refreshing module T. The opening and closing of the valve assembly 2800 may be controlled by a pressure and a temperature inside the accommodating body 2110 or a pressure and a temperature of the outlet 2120.

The heating part 2100 may supply steam by being connected to both the steam iron 1300 and the inner casing 200.

The guide pipe 1500 and the cable 1400 may be equipped as any component as long as they may guide steam supplied from the heating part 800 to a distal end as it is. For example, the guide pipe 1500 and the cable 1400 may be formed in a pipe shape or may be made of a flexible material such as a hose.

The cable 1400 may have one end connected to the branch pipe 2900 or the valve assembly 2800, and the other end coupled to the steam iron 1300. In addition, the guide pipe 1500 connected to the inner casing 200 may have one end connected to the branch pipe 2900 or the valve assembly 2800 and the other end connected to the steam nozzle 900 or the steam hole 233 of the inner casing 200.

In one example, the laundry treating apparatus of the present disclosure may omit the steam nozzle 900 and may allow the guide pipe 1500 to be in direct communication with the steam hole 233.

The pressure sensor 2300 may be disposed upstream of the valve assembly 2800. Accordingly, the valve assembly 2800 may be controlled to determine whether to open or close depending on the pressure sensed by the pressure sensor.

Accordingly, the main controller 700 may control the valve assembly 2800 to open and close the guide pipe 1500 and the cable 1400 depending on the pressure sensed by a steam sensor 860.

In one example, the pressure sensor 2300 may be coupled and fixed to the branch pipe 2900. That is, the pressure sensor 2300 may be disposed anywhere as long as it is able to sense the pressure of steam upstream of the valve assembly 2800.

The main controller 700 or the independent controller 4000 may control the valve assembly 2800 to open when the pressure inside the heating part 2100, which is sensed via the pressure sensor 2300, is equal to or higher than the atmospheric pressure. As a result, a large amount of high-pressure steam may be supplied to the inner casing 200 and the steam iron 1300.

As a result, time for spraying steam when performing the refreshing cycle or removing the wrinkles from the laundry may be saved, and time for the heating part 2100 to operate may also be shortened. In addition, a performance of deodorization and wrinkle removal of the laundry may be further improved.

The laundry treating apparatus of the present disclosure may supply high-pressure steam to the inner casing 200 and the steam iron 1300 via the control of the valve assembly 2800. Furthermore, the laundry treating apparatus of the present disclosure may set the pressures of steam supplied to the inner casing 200 and the steam iron 1300 differently.

For example, the heating part 2100 may supply steam such that the pressure of steam supplied to the steam iron is higher than the pressure of steam supplied to the inner casing via the valve assembly 2800.

Therefore, even when the cable 1400 is longer than the guide pipe 1300, steam may be sufficiently delivered to the steam iron 1300, and steam with a higher pressure may be sprayed onto the surface of the laundry to more reliably remove the wrinkles from the laundry.

For example, the valve assembly 2800 may be controlled to allow the supply of steam to the steam iron and block the supply of steam to the inner casing when the pressure of steam generated in the heating part 2100 is equal to or higher than a set value.

Conversely, the valve assembly 2800 may be controlled to block the supply of steam to the steam iron and allow the supply of steam to the inner casing when the pressure of the heating part 2100 or the pressure of steam is equal to or lower than the set value.

That is, when the pressure of the heating part 2100 is equal to or higher than the set value, the first valve 2810 may be controlled to close the guide pipe 1500, and the second valve 2820 may be controlled to open the cable 1400. On the contrary, when the pressure of the heating part 2100 is equal to or lower than the set value, the first valve 2810 may open the guide pipe 1500 based on the refreshing cycle, but the second valve 2820 may be fundamentally blocked from opening the cable 1400. The set value may correspond to a pressure that is 2 to 3 times higher than the atmospheric pressure.

As a result, even when the single heating part 2100 is equipped, steam of the different pressures may be supplied to the inner casing 200 and the steam iron 1300, via the valve assembly 2800.

The pressure sensor 2300 may induce the water supply pump 2200 to be operated more when the pressure of the heating part 2100 is lower than a reference pressure, and may induce water or steam inside the heating part 2100 to be drained when the pressure of the heating part 2100 is higher than the reference pressure. For example, the reference pressure may be set to be higher than the atmospheric pressure by 1 to 3 bar.

The heating module 2000 may further include a water supply structure 2500 that supplies water to the heating part 2100. Specifically, the water supply structure 2500 may include a flow channel that supplies water to the water supply pump 2200 and a flow channel that supplies water supplied to the water supply pump 2200 to the heating part 2100.

The heating part 2100 may be seated on the base module 3000 and fixed thereto via a fastening member or the like, and the water supply pump 2200 may also be seated on the base module 3000.

The heating module 2000 may include a pump connection pipe 2540 that connects the water supply pump 2200 with the heating part 2100. The pump connection pipe 2540 may be made of a flexible material such as a rubber hose to guide high-pressure water into the heating part 2100.

The water supply structure 2500 may include a supply pipe 2530 that supplies water from the water supply pump 2200 to the heating part 2100. The water supply pump 2200 may be connected to an apparatus connection pipe 2520 that is also connected to a drainage apparatus 2400, and the supply pipe 2530 may connect the heating part 2100 to the apparatus connection pipe 2520.

In one example, the heating module 2000 may include the drainage apparatus 2400 that discharges water inside the heating part 2100 when the heating part 2100 stops operating or when steam generated in the heating part 2100 condenses to generate water.

The drainage apparatus 2400 may be equipped as a pump or as a simple valve. The drainage apparatus 2400 may be located downward of the heating part 2100 and receive water from a drainage port 216 of the heating part 2100.

The drainage apparatus 2400 may be connected to both the water supply structure 2500 and the drainage structure 2600. As a result, a structure of supplying or discharging water to or from the heating part 2100 may be unified to simplify the flow channel and save space.

In this case, water supplied via the apparatus connection pipe 2520 may be delivered to the drainage apparatus 2400, and a drainage connection pipe 2610 may be in communication with the apparatus connection pipe 2520.

The drainage apparatus 2400 may be controlled to selectively open at least one of the drainage connection pipe 2610 and the apparatus connection pipe 2520. When the drainage apparatus 2400 locks at least one of the drainage connection pipe 2610 and the apparatus connection pipe 2520, water supplied via the pump connection pipe 2540 may be supplied to the sting generator 2100 through the apparatus connection pipe 2520.

When the drainage apparatus 2400 opens both the drainage connection pipe 2610 and the apparatus connection pipe 2520, water collected or condensed in the heating part 2100 may be completely discharged via the drainage connection pipe 2610. Accordingly, the apparatus connection pipe 2520 may perform both a role of a flow channel for supplying water to the heating part 2100 and a role of a flow channel for discharging water from the heating part 2100.

The drainage apparatus 2400 may be controlled by the independent controller to be described below.

Figure 16:
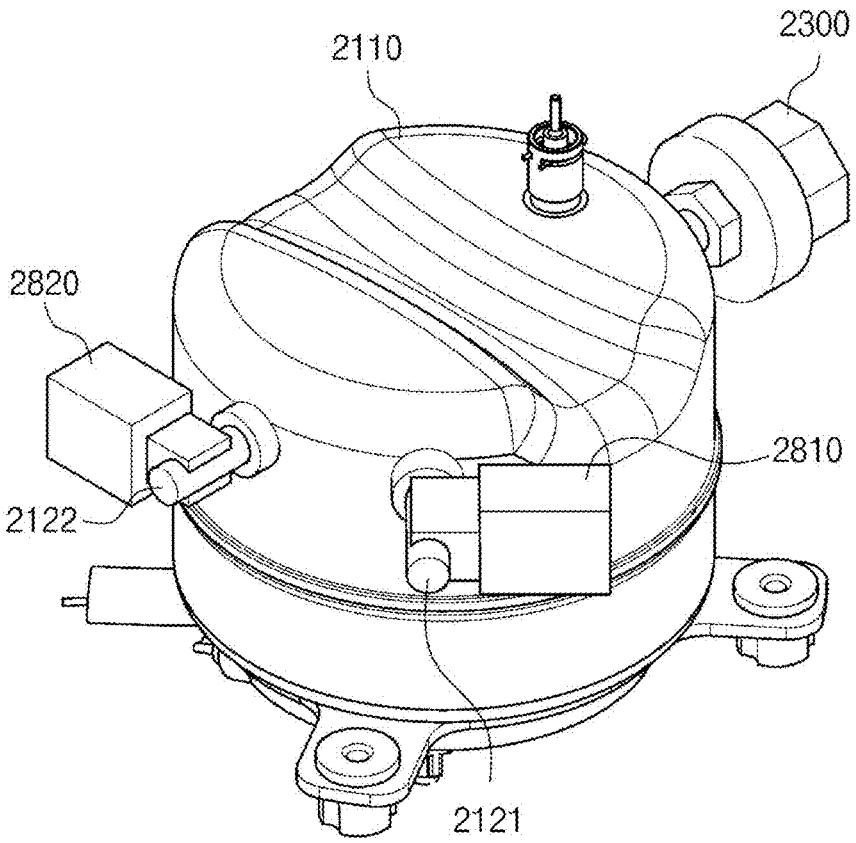
FIG. 16 shows another embodiment of a heating part of the present disclosure.

FIG. 16 shows another embodiment of a heating part of the present disclosure.

The heating part 2100 may have the accommodating body 2110 as a cylindrical pressure casing and may have two outlets 2120.

That is, the accommodating body 2110 may be equipped as a metal casing of one piece that may withstand the pressure of steam that is 2 to 3 times higher than the atmospheric pressure.

In addition, the heating part 2100 may have the two outlets through which steam is discharged. For example, the heating part 2100 may include a first outlet 2121 through which steam is discharged from the accommodating body 2110, and a second outlet 2122 spaced apart from the first outlet 2121 and through which steam is discharged from the accommodating body 2110.

Thus, the heating part 2100 of the present disclosure may omit the branch pipe 2900.

The first outlet 2121 may be connected to the guide pipe 1500, and the second outlet 2122 may be connected to the cable 1400.

The first valve 2810 may be coupled to the first outlet 2121 to open and close the guide pipe 1500, and the second valve 2820 may be coupled to the second outlet 2122 to open and close the cable 1400.

The first valve 2810 and the second valve 2820 may be arranged to be spaced apart from each other by the same distance as the first outlet 2121 and the second outlet 2122 are spaced apart.

Therefore, even when the steam iron 1300 and the steam hole and the like of the inner casing 200 are arranged at different angles with respect to the heating part 800, the first outlet 2121 and the second outlet 2122 may be spaced apart from each other to prevent the guide pipe 1500 or the cable 1400 from interfering with each other or being excessively bent.

The control of the valve assembly 2800 may be the same as that in the embodiment described above.

Figure 17:
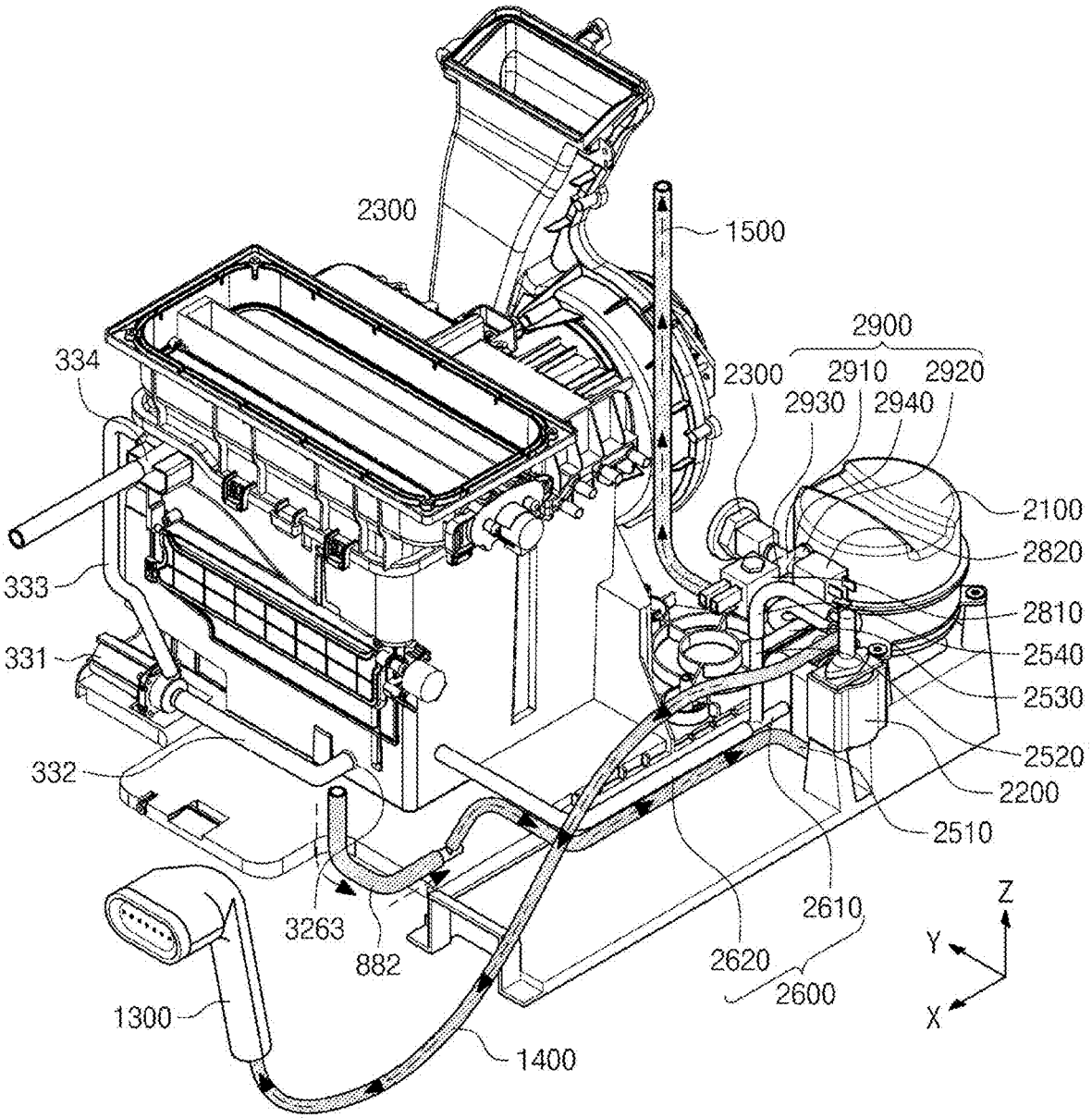
FIG. 17 shows a structure in which the water supply structure and the water supply are in communication with each other.

FIG. 17 shows a structure in which the water supply structure and the water supply are in communication with each other.

The following description is based on the heating part 2100 having one outlet, but this is merely an embodiment. The description may be made in the same manner when the heating part 2100 has a plurality of outlets, except for a branch pipe configuration.

The iron module S may be disposed independently of and installed separately from the refreshing module T, but may be in communication with the heating part 2100 disposed in the machine room 300. As a result, the iron module S may be supplied with steam generated from water stored in the water supply tank 301.

Therefore, the iron module S being connected to the separate water source or arrangement of an additional water supply tank may be omitted.

Additionally, the laundry treating apparatus of the present disclosure may supply steam to both the inner casing 200 and the steam iron 1300 via the single water supply tank 301.

When the water supply pump 2200 is operated, water stored in the water supply tank 301 may pass through the water supply pump 2200 via the supply pipe 882 and be supplied to the heating part 2100 via a water supply connection pipe 2510.

When water supplied to the heating part 2100 is heated, steam may be generated, and steam may be discharged via the outlet 2120.

The valve assembly 2800 may selectively open the outlet 2120, selectively open the branch pipe 2900, or selectively open the guide pipe 1500 and the cable 1400 to selectively move steam from the heating part 2100 to the outside.

When the valve assembly 2800 opens the guide pipe 1500, steam that has passed through the guide pipe 1500 may be discharged to the steam hole of the inner casing 200, or, when the steam nozzle 900 is equipped, may be discharged to the steam hole via the steam nozzle 900.

When the valve assembly 2800 opens the cable 1400, steam that has passed through the cable 1400 may flow to the steam iron 1300 and be discharged.

In one example, the laundry treating apparatus of the present disclosure may control only one of the refreshing module T and the iron module S to operate. This is not only because the iron module S is unable to operate when the door is closed, but also to prevent excessive power consumption.

When one or more of the closing of the door and the operation of the refreshing module T occur, the second valve 2820 may be controlled to close the cable 1400 such that steam is not supplied to the cable 1400.

When one or more of the opening of the door and operation termination of the refreshing module T occur, the first valve 2810 may be controlled to close the cable 1300 such that steam is not supplied to the guide pipe 1300.

The branch pipe 2900 may include a main body pipe 2910 that provides a space for steam to move, an entrance 2920 that connects the main body pipe 2910 with the outlet 2120, a first discharge port 2930 that connects the main body pipe 2910 with the guide pipe 1500, and a second discharge port 2940 that connects the main body pipe 2910 with the cable 1400.

The main body pipe 2910 may be formed in a pipe shape, and may be made of a material having great rigidity such that the valve assembly 2800 may be fixed.

The first valve 2810 may be coupled to the first discharge port 2930 to open and close the first discharge port 2930. Thus, the first valve 2810 may adjust the guide pipe 1500 so as to be selectively in communication with the heating part 2100.

In addition, the second valve 2820 may be coupled to the second discharge port 2940 to open and close the second discharge port 2940. Thus, the second valve 2820 may adjust the cable 1400 so as to be selectively in communication with the heating part 2100.

As a result, when steam is generated in the heating part 2100, it may flow into the main body pipe 2910, but when the valve assembly 2800 closes the discharge ports of the branch pipe 2900, it may be blocked from being supplied to the inner casing 200 and the steam iron 1300.

The drainage structure 2600 may discharge water condensed in the steam generator 2100 or collected in the drainage apparatus 2400.

The water supply structure 2500 may further include the water supply connection pipe 2510 that supplies water from the water supply tank 301 to the heating part 2100 or the water supply pump 2200.

The drainage structure 2600 may include an inflow pipe 2620 that guides water discharged from the drainage apparatus 2400 to the drainage tank 302.

The iron module S may receive water from the water supply tank 301. Accordingly, the iron module S being connected to the separate water source or the arrangement of the additional water supply tank may be omitted. In addition, the laundry treating apparatus may supply steam to both the inside of the inner casing 200 and the steam iron 1300 via the single water supply tank 301.

Figure 18:
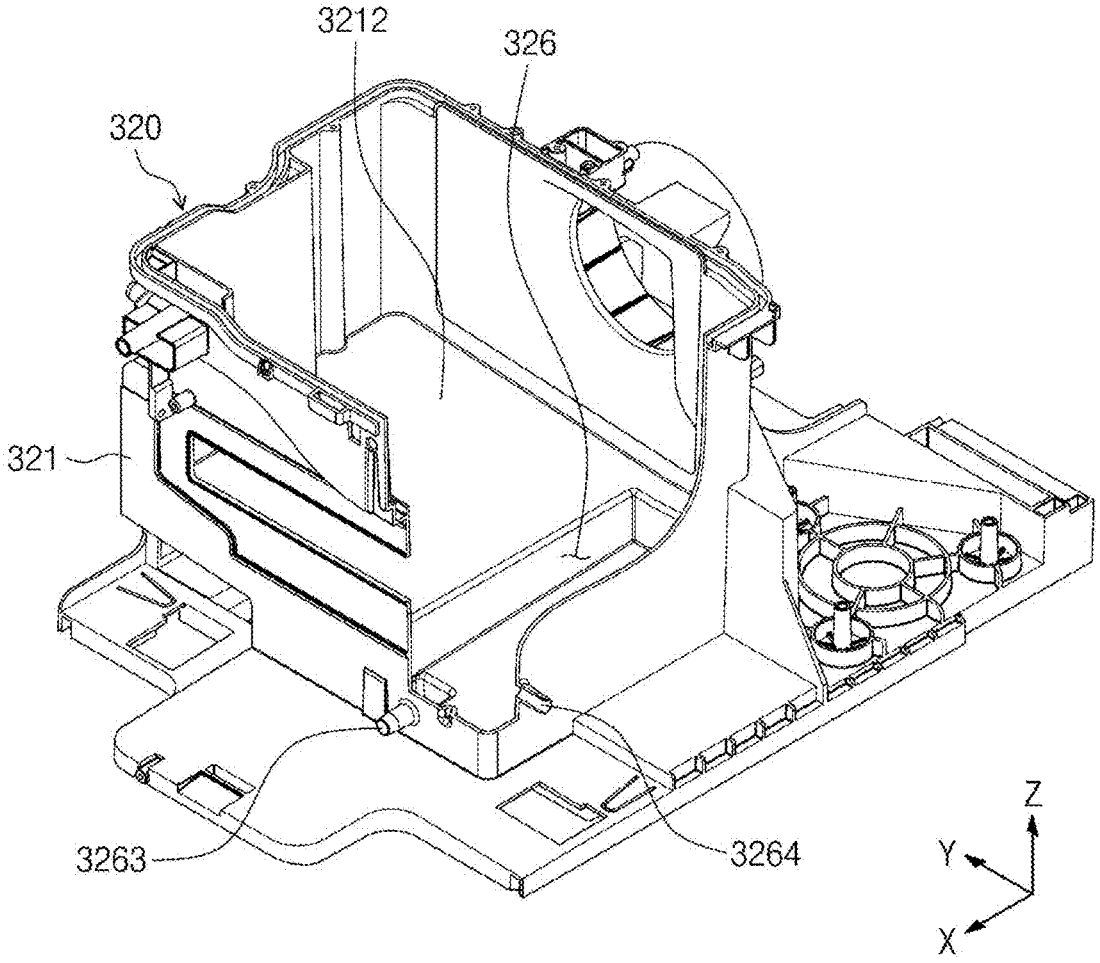
FIG. 18 shows a prerequisite structure in which the drainage structure and the drainage may be in communication with each other.

FIG. 18 shows a prerequisite structure in which the drainage structure and the drainage may be in communication with each other.

The circulation duct 320 may further include an inlet pipe 3264 that guides water discharged from the drainage structure 2600 to the reservoir 260.

A direction in which the inlet pipe 3264 is directed and a direction in which the guide pipe 3263 is directed may be different from each other.

For example, the guide pipe 3263 may be formed on the front surface of the circulation duct 320, and the inlet pipe 3264 may be formed on a left side surface or a right side surface of the circulation duct 320.

The inlet pipe 3264 may be disposed in an area corresponding to a side surface of the reservoir 326 in the side surface of the circulation duct 320.

The inlet pipe 3264 may allow the inside of the reservoir 326 and the outside of the circulation duct 320 to be in communication with each other, and may protrude outward from the side surface of the circulation duct 320.

The inlet pipe 3264 may be installed at a vertical level higher than that of a bottom surface of the reservoir 326 or the guide pipe 3263.

When the drainage structure 2600 discharges water to the inlet pipe 3264, water may be collected in the reservoir 326 and discharged via the guide pipe 3263 to be in communication with the drainage 330.

Therefore, a separate drainage tank for the iron module S may be omitted.

Figure 19:
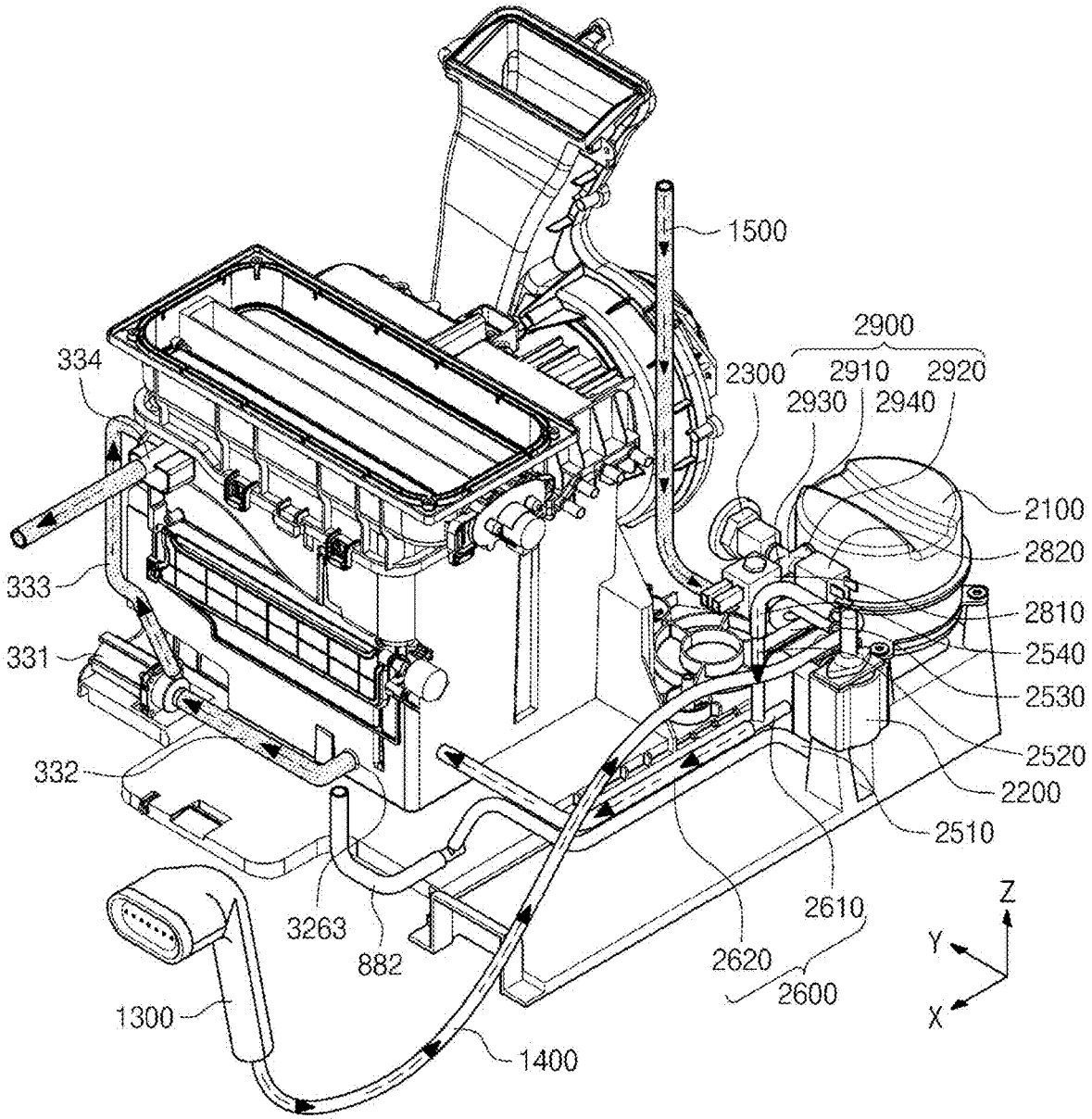
FIG. 19 shows a structure in which the drainage structure and the drainage are in communication with each other.

FIG. 19 shows a structure in which the drainage structure and the drainage are in communication with each other.

The iron module S may be installed independently of and separately from the structure of the machine room 300, but may be in communication with the drainage 330 of the refreshing module T via the circulation duct 320.

As a result, the iron module S may discharge residual water into the drainage tank 302. Therefore, a structure in which the iron module S includes an additional drainage tank 302 or is connected to a separate sewer may be omitted.

The laundry treating apparatus of the present disclosure may collect both residual water collected in the circulation duct 320 and residual water collected in the iron module S with the single drainage tank 302. The user may discharge both water collected in the circulation duct 320 and in the iron module S by dumping water in the drainage tank 302.

The drainage structure 2600 may be in communication with the drainage 330 via the circulation duct 320.

The drainage structure 2600 may include the drainage connection pipe 2610 connected to the drainage apparatus 2400, and the inflow pipe 2620 connected to the drainage connection pipe 2610 to be in communication with the drainage 330. The inflow pipe 2620 may be connected to the inlet pipe 3264.

Condensed water and residual water in the heating part 2100 may be collected in the drainage apparatus 2400 (a direction II). Water condensed in the steam iron 1300 may travel along the cable 1400 and be collected in the drainage apparatus 2400 via the heating part 2100 (a direction I). Water collected in the drainage apparatus 2400 may be connected to the inlet pipe 3264 along the inflow pipe 2620. It may be collected in the drainage tank 302 (a direction III). That is, when the drainage pump 331 is operated, water collected in the drainage apparatus 2400 by a negative pressure may be collected in the drainage tank 302.

The inflow pipe 2620 may be in communication with the inside of the circulation duct 320.

Therefore, all of water collected in the drainage apparatus 2400 may be collected inside the circulation duct 320 and then flow to the drainage pump 331 via the guide pipe 3263. Even when an amount of water collected in the drainage apparatus 2400 is great or an amount of water discharged via the drainage apparatus 2400 is great, water may be collected inside the circulation duct 320, thereby preventing water from overflowing outside the machine room 300.

In one example, the drainage apparatus 2400 may be mounted on the base module 3000 and positioned higher than a distal end of the inflow pipe 2620. Accordingly, even when the drainage apparatus 2400 does not generate any special power, water collected in the drainage apparatus 2400 may be collected in the reservoir 326 along the inflow pipe 2620.

When the drainage pump 331 is operated, water collected in the reservoir 326 may be stored in the drainage tank 302.

Figure 20:
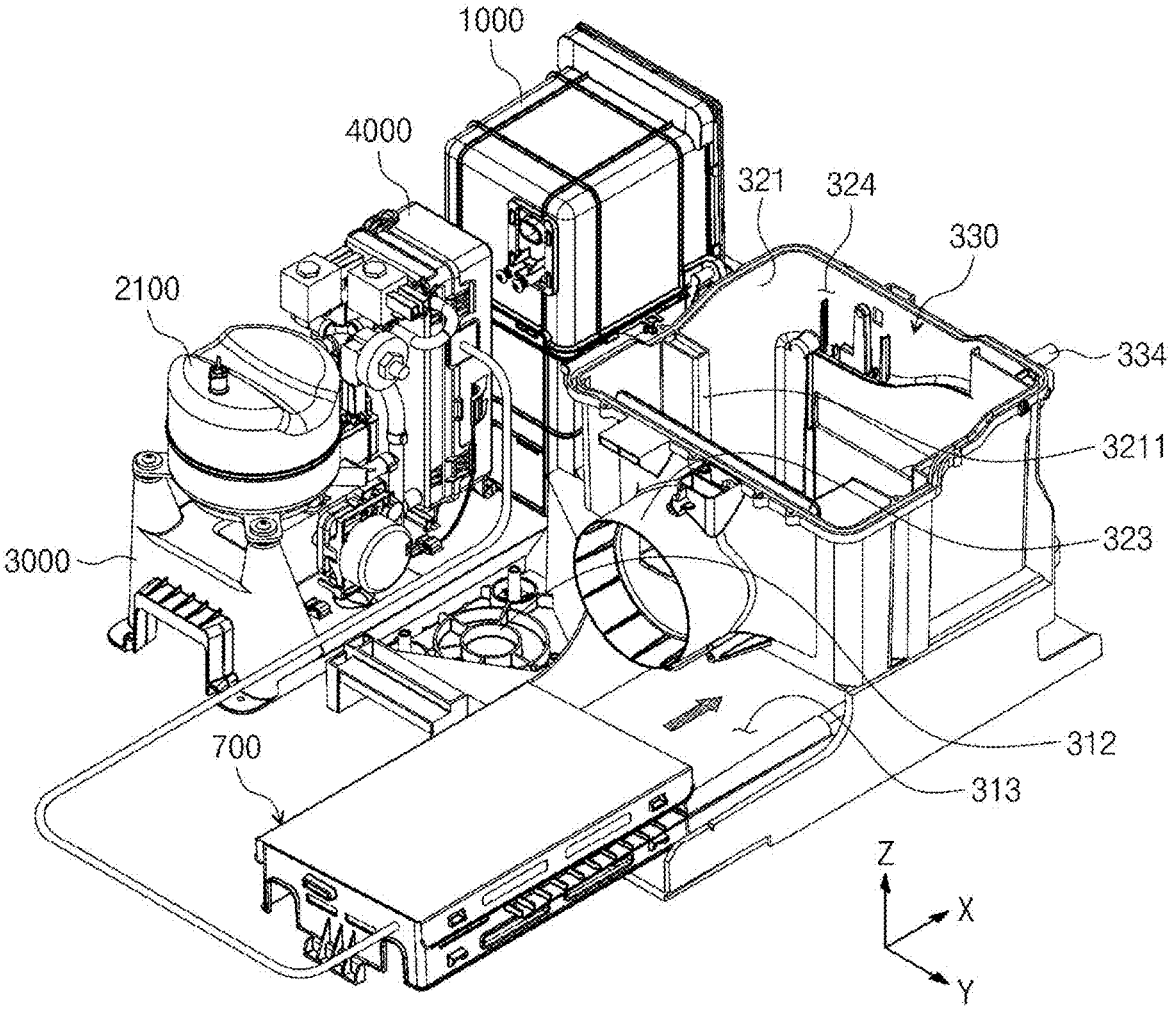
FIG. 20 shows a structure and an arrangement of an iron module and a controller.

FIG. 20 shows a structure and an arrangement of an iron module and a controller.

The main controller 700 may be connected to the external power source and supplied with the power.

The main controller 700 may not only supply the power to the refreshing module T, such as the heat supply part 340, the heating part 2100, the water supply 2500, the drainage 2600, and the blower 350, but also supply the power to all of the electrical components of the laundry treating apparatus 1.

In one example, in the iron module S, the power should also be supplied to the steam iron 1300.

To this end, the main controller 700 may also supply the power to the iron module S.

In addition, the steam iron 1300 needs to have a spray amount of steam, a pressure of steam, and a temperature of steam adjusted by user's manipulation.

In this case, when the main controller 700 is constructed to supply the power to the iron module S or control the iron module S, there is a concern that a size of the main controller 700 may become greater than an area size of the circulation duct 320, and there is a concern that the main controller 700 may not be compatible with a laundry treating apparatus that does not have the iron module S.

Accordingly, the iron module S may further include an independent controller 4000 that may supply the power to the steam iron 1300 or may control the steam iron 1300.

In one example, the steam iron 1300 may be equipped as a component separate from the independent controller 4000.

When the independent controller 4000 is disposed inside the steam iron 1300, the steam iron 1300 may become too large for the user to grip, and a weight of the steam iron 1300 may also make it impossible for the user to grip the steam iron 1300.

Therefore, the iron module S of the present disclosure may not install the independent controller 4000 in the steam iron 1300, but install the independent controller 4000 inside the storage 1200.

As a result, the steam iron 1300 may be equipped with a simple configuration that only includes an ON/OFF switch, a steam spray switch, and the like.

The independent controller 4000 may not be directly connected to the external power source, but may be connected to the main controller 700 via a wire so as to receive the necessary power from the main controller 700. In this case, the main controller 700 may perform a role of an external power source for the iron module S.

Therefore, the laundry treating apparatus of the present disclosure may further include a control line L1 that electrically connects the independent controller 4000 with the main controller 700.

The independent controller 4000 may receive various information from the main controller 700 via the control line L1. The independent controller 4000 may receive information on whether the door 120 has closed the opening 220 and information on whether the refreshing module T is operating, which may be recognized by the main controller 700, via the control line L1, and, and control the iron module S.

The iron module S may be operated regardless of a control state of the refreshing module T because of the independent controller 4000. However, the iron module S is constructed to operate only when the door 120 is opened, and the heat supply part 340 and the heating part 800 should be controlled to operate on the premise that the door 120 is not opened. To this end, the independent controller 4000 is constructed to receive the power from the main controller 700 via the control line L2 and be in communication with the main controller 700 at the same time, so as to recognize the opening state of the door 120 and the operating states of the heat supply part 340 and the heating part 800 to control the iron module S.

In one example, the steam iron 1300 may include a heater that receives the power via the independent controller 4000 and further heats condensed water inside. Because the heater is disposed separately from the independent controller 4000, a capacity may be reduced, and the steam iron 1300 may be maintained in a compact size.

Although not shown, a control line extending from the independent controller 4000 may be inserted into or built into the cable 1400 and extend to the steam iron 1300.

Figure 21:
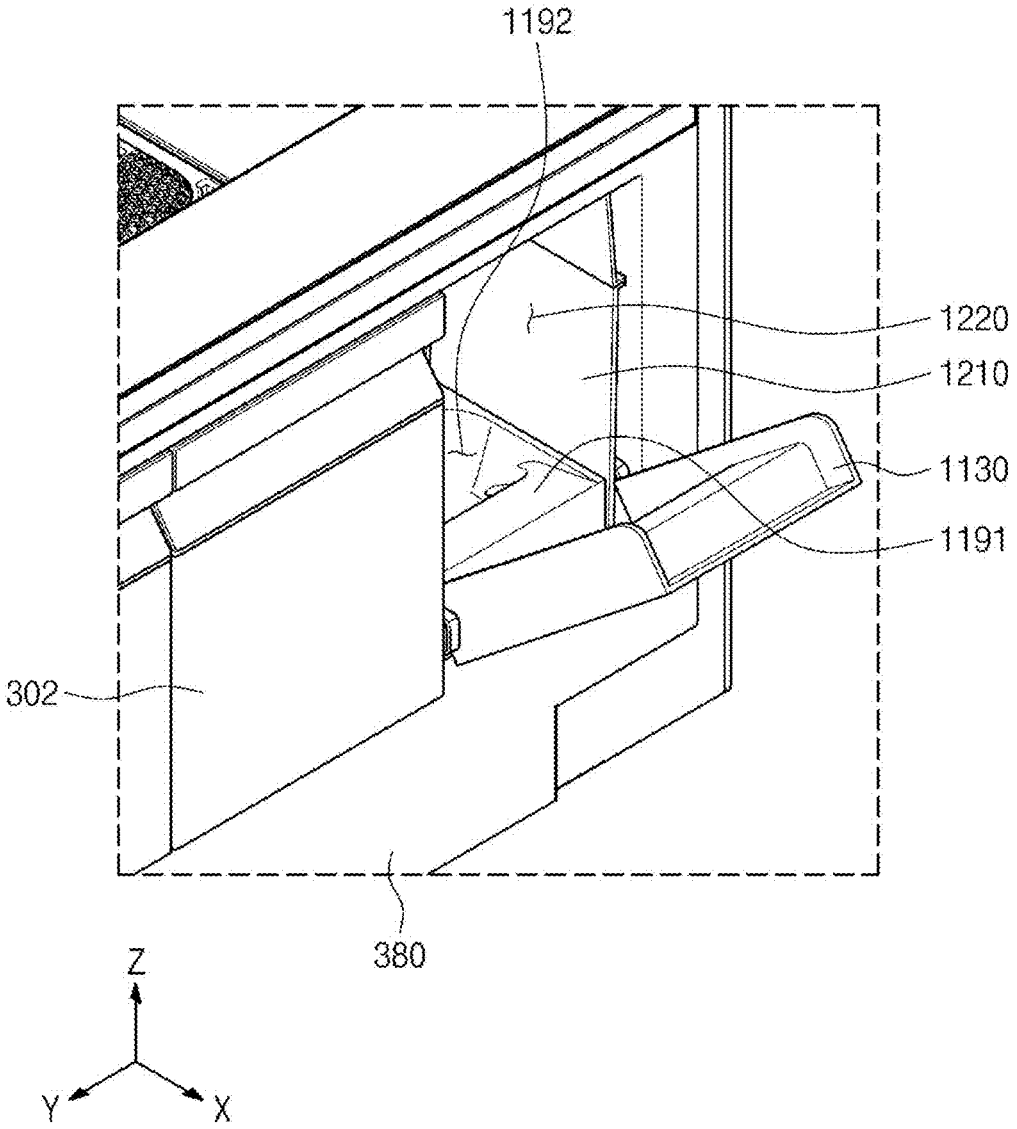
FIG. 21 shows an additional embodiment of the storage module.

FIG. 21 shows an additional embodiment of the storage module.

The storage 1200 of the present disclosure may include the storage body 1210 that stores the steam iron 1300 inside the machine room, and a cover door 1130 that is pivotably disposed in front of the storage body 1210 or on the detachment portion 380 to shield the inside of the storage body 1210.

The storage 1200 may include the open surface 1220 defined in the front surface of the storage body 1210 and through which the steam iron 1300 may be withdrawn.

The cover door 1130 may expose the steam iron 1300 accommodated in the storage body 1210 via simple pivoting. As a result, a component such as the drawer for withdrawing the steam iron 1300 forward from the storage 1200 may be omitted.

The cover door 1130 may have an area size to shield the open surface 1220 or the through-hole of the detachment portion 380. When the cover door 1130 shields the open surface 1220 or the through-hole, the cover door 1130 may be disposed parallel to the water supply tank 301.

The cover door 1130 may have a lower end pivotably disposed on the detachment portion 380 and an upper end constructed to be movable away from the housing 1200.

Accordingly, when the door 120 is closed, the cover door 1130 may automatically close the open surface 1220 of the housing.

The storage 1200 may further include an iron seating portion 1190 that supports the steam iron 1300 at a lower portion of the housing 1200. The iron seating portion 1190 may be constructed such that the head of the steam iron 1300 is detachable therefrom.

The iron seating portion 1190 may include a seating body 1191 mounted on the storage body 1210, and a seating groove 1192 recessed into a top surface of the seating body 1191 to allow the head of the steam iron 1300 to be mounted therein.

The iron seating portion 1190 may be accommodated in the storage body 1210 without being withdrawn via the open surface 1220.

Figure 22:
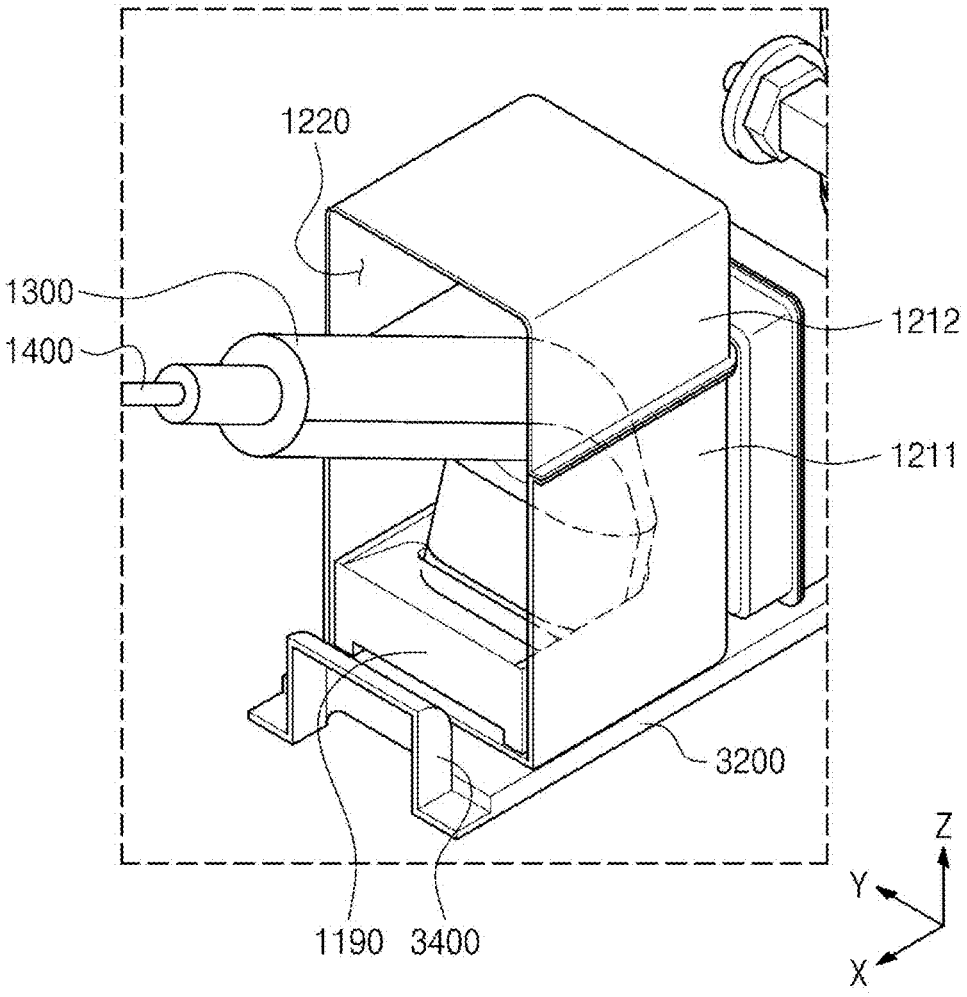
FIG. 22 shows a steam iron accommodated in the housing body.

FIG. 22 shows a steam iron accommodated in the housing body.

The storage body 1210 may include a first body 1211 mounted on a support panel 3200 and a second body 1212 coupled to a top of the first body 1211 to provide a space for storing the steam iron 1300 therein.

A front portion of the first body 1211 may form a lower portion of the open surface 1220, and a front portion of the second body 1212 may form an upper portion of the open surface 1220.

The iron seating portion 1190 that supports the steam iron 1300 may be installed inside the storage body 1210.

The support panel 3200 may further include a hinge 3400 to which the cover door 1130 is pivotably coupled at the front.

The hinge 3400 may be disposed forward of the iron seating portion 1190 and the open surface 1220.

The hinge 3400 may ascend to a vertical level at which a lower end of the cover door 1130 may be disposed at a bottom of the through-hole 385. Accordingly, the cover door 1130 may selectively shield or open the through-hole 385.

The cover door 1130 may open the through-hole 385 to expose the open surface 1220 and the steam iron 1300.

The cover door 1130 may close the through-hole 385 to block the open surface 1220 and the steam iron 1300 from being exposed to the outside.

Figure 23A:
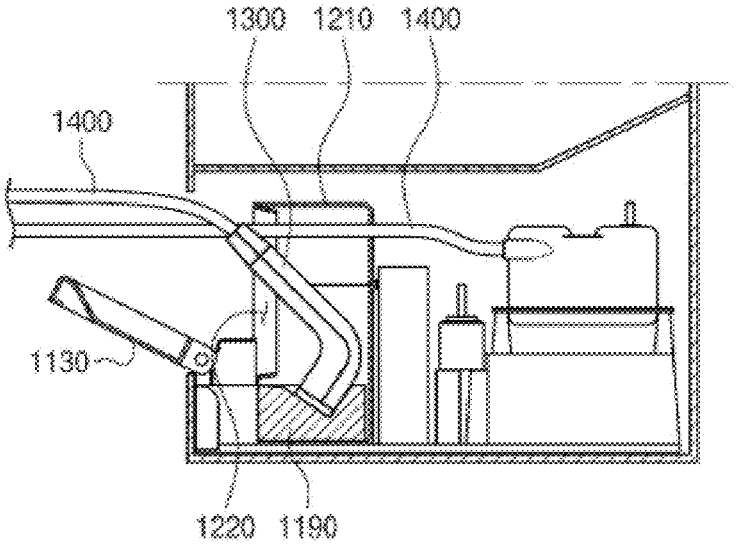
FIGS. 23A to 23C show a scheme of inserting and withdrawing a steam iron.
Figure 23B:
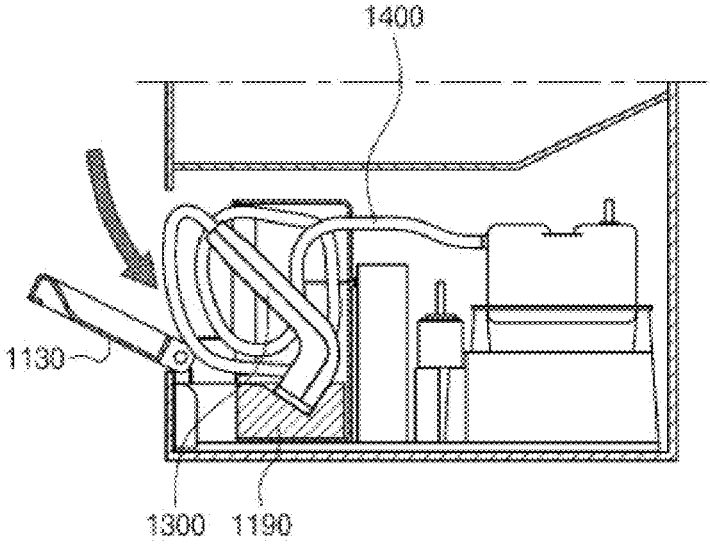
Figure 23C:
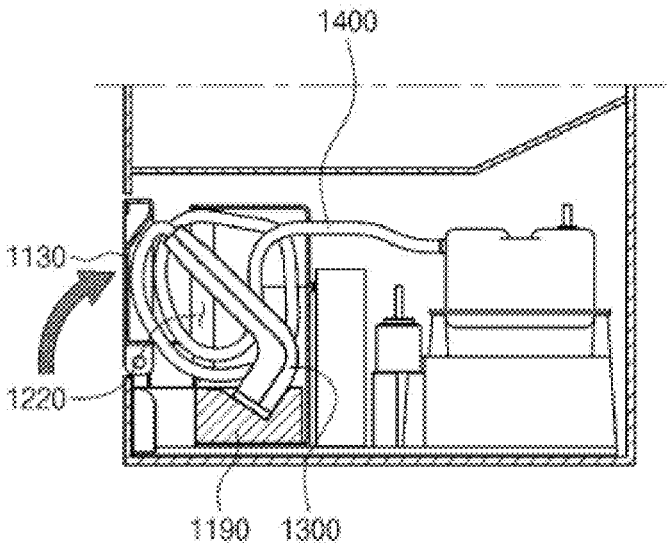

FIGS. 23A to 23C show a scheme of inserting and withdrawing a steam iron.

Referring to FIG. 23A, the cover 1130 may pivot forward to open the through-hole 385. Accordingly, the steam iron 1300 may be withdrawn forward from the housing 1200 via the open surface 1220 and the through-hole 385.

In addition, the steam iron 1300 may be withdrawn and spray steam onto the surface of the laundry, then be inserted into the through-hole 385 again and be inserted into the open surface 1220 to be mounted on the iron seating portion 1190 starting from a head 1310.

Referring to FIG. 23B, the user may roll up the cable 1400 and insert the cable into the through-hole 385. In this regard, a portion of the cable 1400 may be inserted into the storage body 1210, but the remaining portion thereof may be disposed between the open surface 1220 and the through-hole 385.

Referring to FIG. 23C, the cover door 1130 may close the through-hole 385. The steam iron 1300 may have an iron cover 1350 seated on the iron seating portion 1190, and a handle 1311 supported on a rear surface of the cover door 1130.

In addition, at least a portion of the cable 1400 may be supported on the rear surface of the cover 1310.

Therefore, the user may easily insert the steam iron 1300 and the cable 1400 into the through-hole 385, and it may be sufficient for the storage body 1210 to provide a space that accommodates therein only a portion of the steam iron 1300 and a portion of the cable 1400 as long as it accommodates the iron cover 1350 therein.

In other words, the space between the open surface 1220 and the through-hole 385 may be utilized as a space that accommodates the steam iron 1300 and the cable 1400 therein. Therefore, overall length and volume of the iron module S may be reduced.

Figure 24:
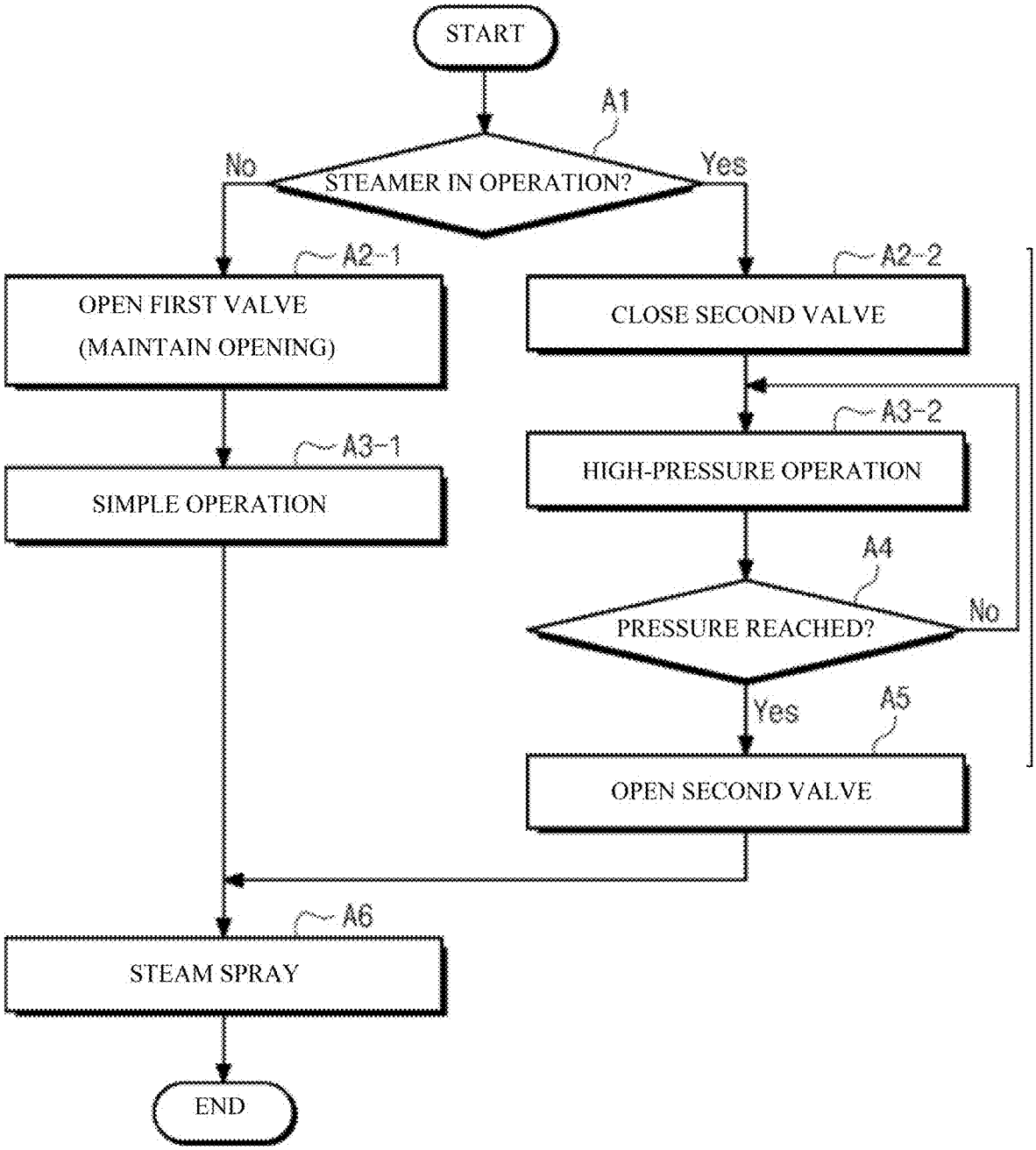
FIG. 24 shows an embodiment of a control method of supplying steam to a steam iron and an inner casing with one heating part.

FIG. 24 shows an embodiment of a control method of supplying steam to a steam iron and an inner casing with one heating part.

The laundry treating apparatus of the present disclosure may heat the single heating part 2100 to supply steam to both the inner casing 200 and the steam iron 1300.

In addition, the laundry treating apparatus of the present disclosure may determine whether to supply steam to the inner casing 200 and the steam iron 1300 via the valve assembly 890 even when steam is generated in the heating part 800.

To this end, the laundry treating apparatus of the present disclosure may perform a mode check step A1 of checking whether a command for operating the iron module S is input or whether the iron module S is activated, or whether a command for operating the refreshing module T is input or whether the refreshing module T is activated.

The mode check step A1 may correspond to sensing via an operation command input to the main controller 700 or the independent controller 4000.

Alternatively, the mode check step A1 may perform the determination via whether the door 120 is opened or closed. That is, this is because only the iron module S may be activated when the door 120 is opened, and the iron module S may not be able to be activated when the door 120 is closed.

When it is determined in the mode check step A1 that the refreshing module T is operating, a first opening step A2-1 of opening the first valve 891 may be performed.

In this case, the second valve 892 may be closed to prevent steam from flowing arbitrarily to the steam iron 1300.

When the heating part 800 is equipped to immediately provide steam to the inner casing 200 when steam is generated and only steam with a pressure corresponding to the atmospheric pressure is provided to the inner casing 200, the first valve 2810 will be maintained in an open state from the beginning, so that the first opening step A2-1 may correspond to maintaining of the open state of the first valve 2810.

In the first opening step A2-1, simple operation A3-1 of simply operating the heating part 800 until water is converted into steam may be included. That is, the heating part 800 may simply heat water until steam may be generated.

When steam is generated, the heating part 2100 may perform a steam spray step A6 of naturally spraying steam to the inner casing 200 along the guide pipe 1500 via the first valve 2810.

When it is determined in the mode check step A1 that the iron module S is operating, a first closing step A2-2 of closing the second valve 892 may be performed. In this case, the first valve 2810 may also be closed, thereby preventing steam from arbitrarily flowing to the inner casing 200.

The heating part 800 may perform a high-pressure operation step A3-2 of heating steam until the pressure of steam reaches the atmospheric pressure or higher. The pressure sensor 2300 may perform a pressure sensing step A4 of sensing that the pressure inside the heating part 2100 corresponds to the set value, and the heating part 2100 may maintain the high-pressure operation step A3-2 until the pressure corresponds to the set value.

In the pressure sensing step A4, when the pressure inside the heating part 2100 reaches the set value, a second opening step A5 of opening the second valve 2820 may be performed.

In the second opening step A5, the first valve 2810 may be kept closed. As a result, the steam spray step A6 of spraying steam generated in the heating part 2100 only to the steam iron 1300 may be performed.

Figure 25:
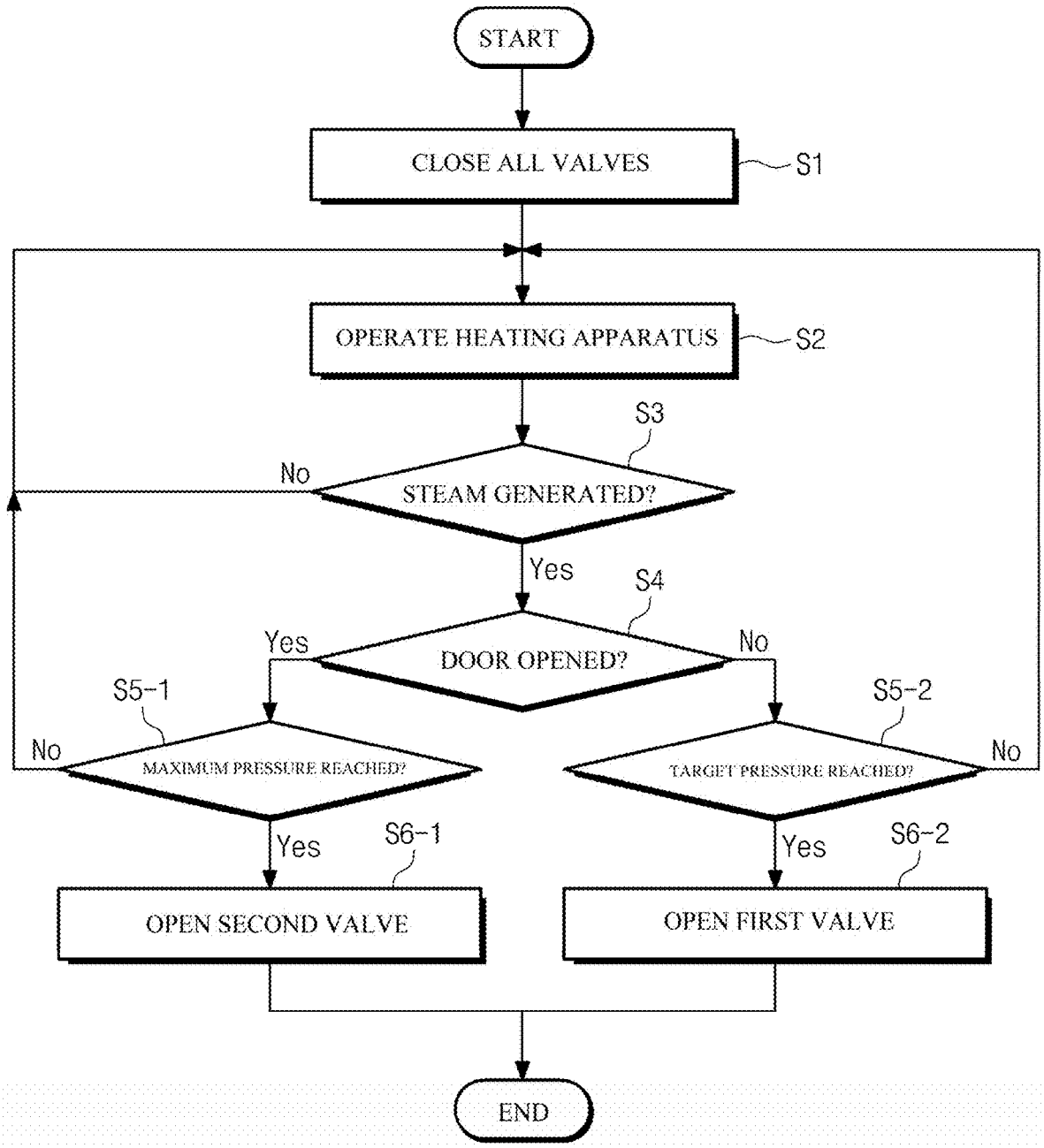
FIG. 25 shows a control method of supplying steam to a steam iron and an inner casing with one heating part.

FIG. 25 shows a control method of supplying steam to a steam iron and an inner casing with one heating part.

The laundry treating apparatus of the present disclosure may include a plurality of valve assemblies 2800, regardless of whether the outlet 2120 of the heating part 2100 is equipped as a single unit and branches to the steam iron 1300 and the inner casing 200 via the branch pipe 2900 or whether the outlet 2120 includes a plurality of outlets respectively allowing the steam iron 1300 and the inner casing 200 to be connected to the heating part 2100.

The first valve 891 may open and close the guide pipe 1500 that supplies steam from the heating part 2100 to the inner casing 200, and the second valve 2820 may open and close the cable 1400 that supplies steam from the heating part 2100 to the steam iron 1300.

In one example, the inner casing 200 and the steam iron 1300 may be physically supplied with steam at the same time.

However, because the refreshing cycle is performed when the door 120 closes the accommodating space 220 of the inner casing, it is preferable that steam is supplied to the inner casing 200 only when the door 120 closes the cabinet 100.

In addition, because the steam iron 1300 is assumed to be withdrawn from the machine room 300, it is preferable that steam is supplied only when the door 120 opens the cabinet 100.

Therefore, the laundry treating apparatus of the present disclosure may control the valve assembly 890 such that only one of the guide pipe 1500 and the cable 1400 is opened.

In addition, because the steam iron 1300 directly sprays steam and heat onto the surface of the laundry in an open space to remove the wrinkles from the laundry, and the inner casing 200 humidifies the laundry with steam in a closed space, it may be preferable that the pressure of steam supplied to the steam iron 1300 is set to be higher than the pressure of steam supplied into the inner casing 200, and it may also be advantageous for the pressure of steam supplied into the inner casing 200 to be higher than the atmospheric pressure.

As a result, the laundry treating apparatus of the present disclosure may set the control of the first valve 2810 and the second valve 2820 differently depending on whether the steam iron 1300 and the heat supply part 340 are in operation, whether the door is open, and the pressure state of steam generated in the heating part 2100.

For example, before the laundry treating apparatus of the present disclosure receives the power, or before the refreshing cycle or the steam iron starts operating even when the power is supplied, the laundry treating apparatus of the present disclosure may perform a closing step S1 of controlling the valve assembly 2800 to close all of steam-related flow channels.

In the closing step S1, the first valve 2810 may be controlled to close the guide pipe 1500, and the second valve 2820 may be controlled to close the cable 1400.

The laundry treating apparatus of the present disclosure may perform a heating step S2 of operating the heating part

2100 to boil water and generate steam when the refreshing cycle starts or a command to operate the steam iron is input.

The heating step S2 may be performed while the closing step S1 is performed. Therefore, in the heating step S2, water other than steam may be prevented from being supplied to the guide pipe 1500 and the cable 1400, and even when steam is generated in the heating step S2, steam may be prevented from being supplied to the guide pipe 1500 and the cable 1400 arbitrarily.

The heating step S2 may be continuously operated until steam is generated in the heating part 2100. The laundry treating apparatus of the present disclosure may perform a sensing step S3 of sensing whether steam is generated in the heating part 2100. The sensing step S3 may include identifying whether steam is generated via the temperature sensor or the pressure sensor 2300 coupled to the heating part 2100.

When it is sensed that steam is generated in the heating part 2100, the laundry treating apparatus of the present disclosure may first determine at least one of whether the door 120 is opened and whether a pressure of generated steam has reached a target value.

For example, the laundry treating apparatus of the present disclosure may maintain the second valve 2820 in the closed state when the door is closed, and may maintain the first valve 2810 in the closed state when the door is open.

In addition, even when the door is closed, when the pressure of steam does not reach the reference value, the first valve 2810 may be maintained in the closed state, and even when the pressure of steam reaches a reference value, the first valve 2810 may be opened only when a current step corresponds to the steam spray step in the refreshing cycle.

In addition, even when the door is open, when the pressure of steam does not reach the set value higher than the reference value, the second valve 2820 may be maintained in the closed state, and even when the pressure of steam reaches the set value, the second valve 2820 may be opened only when a spray button or the like is pressed on the steam iron 1300.

For example, the laundry treating apparatus of the present disclosure may perform a determining step S4 of determining whether the door is open in the sensing step S3 or the operating step S2.

When it is sensed in the determining step S4 that the door is open, the laundry treating apparatus of the present disclosure may perform a high-pressure determining step S5-1 of determining whether the pressure of the heating part 2100 has reached the set value (or a maximum value) while keeping the first valve 2810 closed in any case.

In this case, the operating step S2 of the heating part 2100 may be continued until the pressure of steam reaches the set value.

In the high-pressure determining step S5-1, when the pressure of steam reaches the set value, the laundry treating apparatus of the present disclosure may perform a spray step S6-1 of opening the second valve 2820. In the spray step S6-1, steam may be sprayed at a high pressure to the steam iron 1300 and the first valve 2810 may still be maintained in the closed state.

When it is sensed in the determining step S4 that the door is closed, the laundry treating apparatus of the present disclosure may perform a target determining step S5-2 of determining whether the pressure of the heating part 2100 has reached the reference value (the target value) while keeping the second valve 2820 closed in any case.

In this case, the operating step S2 of the heating part 2100 may be continued until the pressure of steam reaches the reference value.

In the target determining step S5-2, when the pressure of steam reaches the reference value, the laundry treating apparatus of the present disclosure may perform a supply step S6-2 of opening the first valve 2810. In the supply step S6-2, steam may be sprayed into the inner casing 200, and the second valve 2820 may still be maintained in the closed state.

The reference value may be set higher than the atmospheric pressure, and may be set to be higher than 1 atm and lower than 2 atm.

The set value may be set to be equal to or higher than 2 atm and lower than 4 atm as described above.

In addition, whether the door is closed may be determined by a reed switch, a magnet, and the like disposed in the door 120 and the cabinet 100.

The present disclosure may be modified and implemented in various forms, so that the scope of rights thereof is not limited to the above-described embodiments. Therefore, when the modified embodiment includes elements of the claims of the present disclosure, it should be considered to fall within the scope of the present disclosure.

What is claimed is:

1. A laundry treating apparatus comprising:
- a cabinet;
- a door rotatably coupled to the cabinet;
- an inner casing disposed inside the cabinet to provide an accommodating space where laundry is hung, wherein the inner casing is opened by the door;
- a circulation duct disposed under the inner casing to provide a flow channel for air inside the inner casing to circulate;
- a heat supply part configured to heat air flowing along the circulation duct;
- a steam iron disposed on one side of the circulation duct and withdrawable toward the laundry; and
- a heating part disposed on the one side of the circulation duct and at the rear of the steam iron, wherein the heating part is configured to supply steam to the steam iron,
- wherein the heating part is configured to also supply steam into the inner casing.

2. The laundry treating apparatus of claim 1, wherein the heating part is connected to both the steam iron and the inner casing.

3. The laundry treating apparatus of claim 2, further comprising:
- a guide pipe guiding steam supplied from the heating part to the inner casing; and
- a cable guiding steam supplied from the heating part to the steam iron.

4. The laundry treating apparatus of claim 3, wherein the heating part further includes a valve assembly configured to open and close the guide pipe and the cable.

5. The laundry treating apparatus of claim 4, wherein the valve assembly is controlled to close the cable in case that the guide pipe is opened, and to close the guide pipe in case that the cable is opened.

6. The laundry treating apparatus of claim 4, wherein the valve assembly is configured to open the guide pipe and the cable at different pressures.

7. The laundry treating apparatus of claim 6, wherein the valve assembly includes:
- a first valve configured to open and close the guide pipe; and
- a second valve configured to open and close the cable,
- wherein the second valve is controlled to open at a pressure higher than a pressure of the first valve.

8. The laundry treating apparatus of claim 6, wherein the heating part further includes:

an accommodating body accommodating water therein and configured to heat water; and a pressure sensor configured to sense a pressure of steam generated in the accommodating body, wherein the valve assembly is configured to allow the supply of steam to the steam iron and to block the supply of steam to the inner casing in case that the pressure of steam generated in the heating part is equal to or higher than a set value.

9. The laundry treating apparatus of claim 8, wherein the valve assembly is configured to block the supply of steam to the steam iron and to guide steam to be supplied to the inner casing in case that the pressure of steam is equal to or lower than the set value.

10. The laundry treating apparatus of claim 8, wherein the heating part includes:

an outlet allowing steam to be discharged from the accommodating body; and a branch pipe connecting the outlet with the guide pipe and the cable, wherein the pressure sensor and the valve assembly are coupled to the branch pipe.

11. The laundry treating apparatus of claim 10, wherein the pressure sensor is disposed upstream of the valve assembly.

12. The laundry treating apparatus of claim 10, wherein the valve assembly includes:

a first valve coupled to the branch pipe to selectively open and close the guide pipe; and a second valve coupled to the branch pipe to selectively open and close the cable.

13. The laundry treating apparatus of claim 8, wherein the heating part includes:

a first outlet connecting the accommodating body with the guide pipe; and a second outlet connecting the accommodating body with the cable, wherein the valve assembly includes:

a first valve configured to open and close the first outlet; and a second valve configured to open and close the second outlet.

14. The laundry treating apparatus of claim 1, further comprising a water supply tank detachably disposed in front of the circulation duct and storing water therein, wherein the heating part is configured to receive water from the water supply tank and generate steam to be supplied to the steam iron and the inner casing.

15. The laundry treating apparatus of claim 14, further comprising a water supply pump configured to supply water stored in the water supply tank to the heating part.

* * * * *